US007619595B2

(12) United States Patent
Uchino et al.

(10) Patent No.: US 7,619,595 B2
(45) Date of Patent: Nov. 17, 2009

(54) DISPLAY DEVICE

(75) Inventors: Katsuhide Uchino, Kanagawa (JP); Tetsuro Yamamoto, Kanagawa (JP); Junichi Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 87 days.

(21) Appl. No.: 12/071,855

(22) Filed: Feb. 27, 2008

(65) Prior Publication Data

US 2008/0224621 A1 Sep. 18, 2008

(30) Foreign Application Priority Data

Mar. 13, 2007 (JP) ..... 2007-062777

(51) Int. Cl.
*G09G 3/30* (2006.01)

(52) U.S. Cl. ..... 345/76; 315/169.3

(58) Field of Classification Search ..... 345/76–83, 345/36, 39; 315/169.3; 313/463
See application file for complete search history.

(56) References Cited

U.S. PATENT DOCUMENTS 5,684,365 A 11/1997 Tang et al.
7,248,237 B2 * 7/2007 Yamada et al. ..... 345/76
7,274,345 B2 * 9/2007 Imamura et al. ..... 345/76
7,317,434 B2 * 1/2008 Lan et al. ..... 345/76
2005/0237273 A1 * 10/2005 Ozawa et al. ..... 345/46

FOREIGN PATENT DOCUMENTS

JP 08-234683 9/1996

* cited by examiner

*Primary Examiner*—Jimmy H Nguyen
(74) *Attorney, Agent, or Firm*—Rader, Fishman & Grauer PLLC

(57) ABSTRACT

A display device includes a pixel area where a plurality of pixels are arranged in a matrix and a driving circuit for driving the pixel area. Each of the pixels includes a signal-level holding capacitor having two ends, a first transistor that is turned on and off in accordance with a write signal, a second transistor having a gate connected to the one end of the signal-level holding capacitor and a source connected to the other end of the signal-level holding capacitor, a current-driven self-luminous light-emitting element having a cathode held at a cathode potential and an anode connected to the source of the second transistor, a third transistor that is turned on and off in accordance with a driving-pulse signal, and a fourth transistor that is turned on and off in accordance with a control signal.

5 Claims, 18 Drawing Sheets

DISPLAY DEVICE

CROSS REFERENCES TO RELATED APPLICATIONS

The present invention contains subject matter related to Japanese Patent Application JP 2007-062777 filed in the Japanese Patent Office on Mar. 13, 2007, the entire contents of which are incorporated herein by reference.

BACKGROUND OF THE INVENTION

1. Field of the Invention

The present invention relates to display devices, and more particularly, to a current-driven self-luminous display device using an organic electroluminescence (EL) element or the like. The present invention sets the gate voltage and the source potential of a transistor for driving a light-emitting element to predetermined fixed potentials so that a variation in luminous intensity caused by a variation in a threshold voltage of the transistor can be corrected, and the source of the transistor is set to have the fixed potential from a signal line SIG. Thus, compared with the related art, a reduced number of scanning lines and a reduced number of wiring patterns for fixed potentials can be achieved.

2. Description of the Related Art

Concerning display devices using organic EL elements, technologies described, for example, in U.S. Pat. No. 5,684,365 and Japanese Unexamined Patent Application Publication No. 8-234683 have been suggested.

FIG. 14 is a block diagram showing a so-called active-matrix-type display device using an organic EL element of the related art. In a display device 1, a pixel area 2 includes a plurality of pixels PX 3 arranged in a matrix. In the pixel area 2, for the pixels 3, which are arranged in a matrix, scanning lines SCN are provided in a horizontal direction for individual lines, and signal lines SIG are provided for individual columns so as to intersect the scanning lines SCN.

As shown in FIG. 15, each of the pixels 3 includes an organic EL element 8, which is a current-driven self-luminous light-emitting element, and a driving circuit (hereinafter, referred to as a "pixel circuit") for driving the organic EL element 8.

In the pixel circuit, one end of a signal-level holding capacitor C1 is held at a constant potential and the other end of the signal-level holding capacitor C1 is connected to a signal line SIG through a transistor TR1, which is turned on and off in accordance with a write signal WS. Thus, in the pixel circuit, the transistor TR1 is turned on in accordance with the rising of the write signal, the potential of the other end of the signal-level holding capacitor C1 is set to the signal level of the signal line SIG, and the signal level of the signal line SIG is sampled and held by the other end of the signal-level holding capacitor C1 at a time when the on-state transistor TR1 is turned off.

In the pixel circuit, the other end of the signal-level holding capacitor C1 is connected to the gate of a P-channel transistor TR2, the source of which is connected to a power supply Vcc, and the drain of the transistor TR2 is connected to the anode of the organic EL element 8. The pixel circuit is set such that the transistor TR2 operates in a saturation region. As a result, the transistor TR2 forms a constant-current circuit exhibiting a drain-source current Ids, which is represented by expression (1). Here, "Vgs" represents the gate-source voltage of the transistor TR2, and μ represents the mobility. In addition, "W" represents a channel width, "L" represents a channel length, "Cox" represents a gate capacitance, and "Vth" represents a threshold voltage of the transistor TR2. Thus, in each of the pixel circuits, the organic EL element 8 is driven in accordance with a driving current Ids, which corresponds to the signal level of the signal line SIG sampled and held by the signal-level holding capacitor C1.

$$Ids - \frac{1}{2} \times \mu \times \frac{W}{L} \times Cox \times (Vgs - Vth)^2 \quad (1)$$

In the display device 1, a write scan circuit (WSCN) 4A of a vertical driving circuit 4 sequentially transfers predetermined sampling pulses to generate write signals WS, which are timing signals for indicating writing to the pixels 3. In addition, a horizontal selector (HSEL) 5A of a horizontal driving circuit 5 sequentially transfers predetermined sampling pulses to generate timing signals, and sets each of the signal lines SIG to have the signal level of an input signal S1 in accordance with a corresponding timing signal. Thus, the display device 1 sets, dot sequentially or line sequentially, the terminal voltage of the signal-level holding capacitor C1 provided in each of the pixels 3 in accordance with the input signal S1, and displays an image based on the input signal S1.

As shown in FIG. 16, the current-voltage characteristic of the organic EL element 8 changes with time in a direction in which the flow of current becomes restricted as the usage time increases. Referring to FIG. 16, "L1" represents an initial characteristic and "L2" represents a characteristic that changes with time. However, in a case where the organic EL element 8 is driven by the P-channel transistor TR2 in the circuit configuration shown in FIG. 15, since the organic EL element 8 is driven by the transistor TR2 in accordance with the gate-source voltage Vgs, which is set on the basis of the signal level of the signal line SIG, a change in the luminous intensity of a pixel that can be caused by a change in the current-voltage characteristic with time is prevented.

If all the transistors in the pixel circuits, the horizontal driving circuit, and the vertical driving circuit are of a N-channel type, all the circuits can be formed together on an insulating substrate, such as a glass substrate, by an amorphous-silicon process. Thus, a display device can be produced easily.

However, as shown in FIG. 17, which is provided for comparison with FIG. 15, in a case where a N-channel transistor is used as a transistor TR2 forming each of a plurality of pixels 13 and a display device 11 includes a pixel area 12 including such pixels 13, since the source of the transistor TR2 is connected to the organic EL element 8, the gate-source voltage Vgs of the transistor TR2 changes in accordance with a change in the current-voltage characteristic shown in FIG. 16. Thus, in this case, as the usage time increases, the current flowing to the organic EL element 8 gradually decreases, and the luminous intensity of each of the pixels gradually decreases. In addition, with the configuration shown in FIG. 17, the luminous intensity varies depending on the pixel in accordance with a variation in the characteristic of the transistor TR2. The variation in the luminous intensity disrupts the uniformity of the display screen, and such a variation is perceived as unevenness and roughness of the display screen.

Thus, in order to prevent a reduction in luminous intensity from being caused by such a change of an organic EL element with time and to prevent a variation in luminous intensity from being caused by a variation in a characteristic of a transistor, the configuration shown in FIG. 18 has been suggested.

In a display device 21 shown in FIG. 18, a pixel area 22 includes a plurality of pixels 23 arranged in a matrix. In each of the pixels 23, one end of the signal-level holding capacitor C1 is connected to the anode of the organic EL element 8 and the other end of the signal-level holding capacitor C1 is connected to a signal line SIG through the transistor TR1, which is turned on and off in accordance with a write signal WS. Thus, the voltage at the other end of the signal-level holding capacitor C1 is set to the signal level of the signal line SIG in accordance with the write signal WS.

In the pixel 23, the ends of the signal-level holding capacitor C1 are connected to the source and the gate of the transistor TR2, and the drain of the transistor TR2 is connected to a power supply Vcc through a transistor TR3, which is turned on and off in accordance with a driving-pulse signal DS. Thus, in the pixel 23, the transistor TR2, which has a source-follower circuit configuration in which the gate potential of the transistor TR2 is set to the signal level of the signal line SIG, drives the organic EL element 8. Here, "Vcat" represents the cathode potential of the organic EL element 8. In addition, the driving-pulse signal DS serves as a timing signal for controlling a light-emission period of the pixel 23. A drive scan circuit (DSCN) 24B sequentially transfers predetermined sampling pulses to generate timing signals.

In addition, in the pixel 23, the ends of the signal-level holding capacitor C1 are connected to predetermined fixed potentials Vofs and Vss through transistors TR4 and TR5, which are turned on and off in accordance with control signals AZ1 and AZ2, respectively. Control-signal generation circuits 24C and 24D provided in a vertical driving circuit 24 sequentially transfer predetermined sampling pulses to generate the control signals AZ1 and AZ2, which serve as timing signals.

FIG. 19 is a timing chart of a single pixel 23 in the display device 21. In FIG. 19, symbols representing transistors that are turned on and off in accordance with corresponding signals are represented together with the corresponding signals. As shown in FIG. 20, in a light-emission period T1 where the organic EL element 8 emits light, in the pixel 23, a write signal WS and control signals AZ1 and AZ2 exhibit a low level (see parts (A) to (C) of FIG. 19) so that the transistors TR1, TR4, and TR5 are set to be off, and a driving-pulse signal DS exhibits a high level (see part (D) of FIG. 19) so that the transistor TR3 is set to be on.

Accordingly, in the pixel 23, a constant-current circuit based on the gate-source voltage Vgs, which corresponds to the potential difference across the signal-level holding capacitor C1, is formed by the transistor TR2 and the signal-level holding capacitor C1. The organic EL element 8 is caused to emit light in accordance with a drain-source current Ids, which is determined on the basis of the gate-source voltage Vgs. Thus, a reduction in the luminous intensity due to a change of the organic EL element 8 with time is prevented. The drain-source current Ids is represented by expression (1), which has been described with reference to FIG. 15. Hereinafter, transistors may be represented by symbols indicating switches.

Then, in the subsequent period T2, in the pixel 23, the transistors TR4 and TR5 are on, as shown in FIG. 21. Thus, in the pixel 23, the potentials at the ends of the signal-level holding capacitor C1 are set to the predetermined fixed potentials Vofs and Vss (see parts (E) and (F) of FIG. 19), and the drain-source current Ids corresponding to the gate-source voltage Vgs, which corresponds to a potential difference (Vofs−Vss) between the fixed potentials Vofs and Vss, flows from the transistor TR2 to the transistor TR5. During the period T2, in order not to cause the organic EL element 8 to emit light, because the potential difference across the organic EL element 8 becomes smaller than a threshold voltage Vthel of the organic EL element 8 and in order to cause the transistor TR2 to operate in a saturation region, the fixed potentials Vofs and Vss are set.

Then, in the pixel 23, during a predetermined period T3, the transistor TR5 is off, as shown in FIG. 22. Thus, in the pixel 23, the voltage at the end of the signal-level holding capacitor C1 closer to the transistor TR5 increases in accordance with the drain-source current Ids of the transistor TR2, as represented by a broken line of FIG. 22.

Here, as shown in FIG. 23, the organic EL element 8 can be represented by an equivalent circuit using a parallel circuit including a diode and a capacitor having a capacitance of Cel. Thus, in accordance with the drain-source current Ids of the transistor TR2, the source voltage Vs of the transistor TR2 gradually increases in the period T3, as shown in FIG. 24. As a result, in the pixel 23, the potential difference across the signal-level holding capacitor C1 is set to the threshold voltage Vth of the transistor TR2, and the terminal voltage at the end of the signal-level holding capacitor C1 closer to the transistor TR5 is set to a voltage (Vofs−Vth), which is obtained by subtracting the threshold voltage Vth of the transistor TR2 from the fixed potential Vofs. In this state, the anode potential Vel of the organic EL element 8 is represented by the expression Vel=Vofs−Vth. In the display device 21, the fixed potential Vofs is set so as to satisfy the expression Vel≦Vcat+Vthel, so that the organic EL element 8 does not emit light during the period T3.

Then, in the subsequent period T4, in the pixel 23, the transistors TR3 and TR4 are sequentially turned off, as shown in FIG. 25. Since the turning off of the transistor TR3 is performed prior to the turning off of the transistor TR4, a variation in the gate voltage Vg of the transistor TR2 can be suppressed. Then, in the pixel 23, the transistor TR1 is turned on. Thus, in a state where the terminal voltage at the end of the signal-level holding capacitor C1 closer to the transistor TR5 is set to the voltage (Vofs−Vth), the voltage at the end of the signal-level holding capacitor C1 closer to the transistor TR4 is set to the signal level Vsig of the signal line SIG.

In this case, the gate-source voltage Vgs of the transistor TR2 is accurately represented by expression (2). Here, "C2" represents the gate-source capacitance of the transistor TR2. However, since the parasitic capacitance Cel of the organic EL element 8 is larger than the capacitance of the signal-level holding capacitor C1 and the gate-source capacitance C2 of the transistor TR2, the gate-source voltage Vgs of the transistor TR2 can be set to the voltage (Vsig+Vth) with a sufficient accuracy.

$$Vgs = \frac{Cel}{Cel + C1 + C2} \times (Vsig - Vofs) + Vth \tag{2}$$

Thus, in the pixel 23, the gate-source voltage Vgs of the transistor TR2 is set to the voltage (Vsig+Vth), which is obtained by adding the threshold voltage Vth to the signal level Vsig of the signal line SIG. Thus, in the display device 21, a variation in the luminous intensity that can be caused by a variation in the threshold voltage Vth, which is a characteristic of the transistor TR2, is prevented.

Then, in a predetermined period T5, in the pixel 23, the transistor TR1 is maintained on and the transistor TR3 is turned on, as shown in FIG. 26. Thus, in the pixel 23, the drain-source current Ids flows from the transistor TR2 in accordance with the gate-source voltage Vgs, which corresponds to the potential difference across the signal-level holding capacitor C1. At this time, if the source voltage Vs of the transistor TR2 is smaller than a voltage obtained by adding the threshold voltage Vthel of the organic EL element 8 and the cathode voltage Vcat and the current flowing to the organic EL element 8 is small, the source voltage Vs of the transistor TR2 gradually increases from the voltage Vs0 in accordance with the drain-source voltage Ids of the transistor TR2, as shown in FIG. 27. The voltage Vs0 is represented by expression (3).

$$Vs0 = Vofs - Vth + \frac{Cel}{Cel + C1 + C2} \times (Vsig - Vofs) \quad (3)$$

Here, the speed of the increase in the source voltage Vs depends on the mobility μ of the transistor TR2. As shown in FIG. 27, where "Vs1" represents a case of a large mobility and "Vs2" represents a case of a small mobility, the larger the mobility, the higher the speed of the increase in the source voltage Vs.

In the pixel 23, only in the period T5, the transistor TR3 is on while the transistor TR1 is maintained on. Thus, a variation in the luminous intensity that can be caused by a variation in the mobility, which is a characteristic of the transistor TR2, is prevented.

Then, in the pixel 23, the transistor TR1 is set to be off, and the organic EL element 8 is driven by the gate-source voltage Vgs, which is set by correcting the threshold voltage Vth and the mobility μ, as shown in FIG. 20. As a result, due to the turning off of the transistor TR1, the source voltage Vs of the transistor TR2 increases to a voltage at which the drain-source current Ids of the transistor TR2 is able to flow to the organic EL element 8. Thus, the organic EL element 8 starts emitting light. As a result, the gate voltage Vg of the transistor TR2 increases.

With the configuration shown in FIG. 18, a reduction in the luminous intensity that can be caused by a change of the organic EL element 8 with time is prevented. In addition, a variation in the luminous intensity that can be caused by a variation in a characteristic of the transistor TR2 is prevented.

However, with the configuration shown in FIG. 18, a signal line SIG, four scanning lines for control signals AZ2 and AZ1, a driving-pulse signal DS, and a write signal WS and four wiring patterns for fixed potentials Vcc, Vofs, Vss, and Vcat are provided for a single pixel 23. The wiring pattern for the fixed potential Vcat is formed by evaporating a metal film over the entire panel. Thus, even if a common scanning line is used for red, blue, and green pixels, wiring patterns for four scanning lines and wiring patterns for nine (3×3) fixed potentials are provided for a pixel group including a red pixel, a blue pixel, and a green pixel.

Thus, in a display device of the related art using N-channel transistors, the number of wiring patterns for scanning lines and for fixed potentials increases. In a case where the number of wiring patterns increases, it is difficult to efficiently arrange pixels with high densities. Thus, it is difficult to manufacture a high-precision display device with a high yield rate.

SUMMARY OF THE INVENTION

It is desirable to provide a display device with a reduced number of wiring patterns for scanning lines and for fixed potentials compared with the related art.

A display device according to an embodiment of the present invention includes a pixel area where a plurality of pixels are arranged in a matrix and a driving circuit for driving the pixel area. Each of the pixels includes a signal-level holding capacitor having two ends, a first transistor that is turned on and off in accordance with a write signal, the first transistor connecting one end of the signal-level holding capacitor to a signal line, a second transistor having a gate connected to the end of the signal-level holding capacitor closer to the first transistor and a source connected to the other end of the signal-level holding capacitor, a current-driven self-luminous light-emitting element having a cathode held at a cathode potential and an anode connected to the source of the second transistor, a third transistor that is turned on and off in accordance with a driving-pulse signal, the third transistor connecting a drain of the second transistor to a power-supply voltage, and a fourth transistor that is turned on and off in accordance with a control signal, the fourth transistor setting the one end of the signal-level holding capacitor to have a first fixed potential. The driving circuit outputs the write signal, the driving-pulse signal, and the control signal. The driving circuit alternately sets the signal line to have a second fixed potential and to have a signal level corresponding to a gray-scale level of each pixel connected to the signal line. The driving circuit drives the pixel area by sequentially cyclically repeating settings performed in first to fifth periods. In the first period, the driving circuit sets the first and fourth transistors to be off in accordance with the write signal and the control signal, sets the third transistor to be on in accordance with the driving-pulse signal, and drives the self-luminous light-emitting element using the second transistor in accordance with a current value corresponding to a gate-source voltage based on a potential difference across the signal-level holding capacitor to cause the self-luminous light-emitting element to emit light. In the second period, the driving circuit sets the third transistor to be off in accordance with the driving-pulse signal to cause the self-luminous light-emitting element to stop emitting light. In the third period, after setting the fourth transistor to be on in accordance with the control signal so that the one end of the signal-level holding capacitor exhibits the first fixed potential, the driving circuit sets the fourth transistor to be off in accordance with the control signal, and sets the first transistor to be on in accordance with the write signal during a period in which the signal line is set to have the second fixed potential, so that the one end and the other end of the signal-level holding capacitor exhibit the second fixed potential and a predetermined potential. In the fourth period, during a period in which the signal line is repeatedly set to have the second fixed potential a plurality of times, in a state where the first transistor is set to be on in accordance with the write signal and the fourth transistor is set to be off in accordance with the control signal, in a period in which the signal line is set to have the second fixed potential, the driving circuit sets the third transistor to be on in accordance with the driving-pulse signal so that the potential difference across the signal-level holding capacitor is set to be substantially equal to a threshold voltage of the second transistor. In the fifth period, the driving circuit sets the on-state first transistor to be off in accordance with the write signal so that the one end of the signal-level holding capacitor is set to have the signal level of the signal line.

With this configuration, the gate voltage of the second transistor for driving the self-luminous light-emitting element is set to have the first fixed potential, and then set to have the second fixed potential. The source voltage of the second transistor is set to have a potential that is determined in accordance with a characteristic of the self-luminous light-emitting element, and changes to a predetermined voltage in accordance with so-called coupling in conjunction with a change of the gate voltage. Thus, after the potential difference across the signal-level holding capacitor is set in advance to be equal to or more than a threshold voltage of the second transistor, the source voltage of the second transistor rises so that the potential difference across the signal-level holding capacitor exhibits a voltage that is substantially equal to the threshold voltage of the second transistor. Accordingly, the gate voltage and the source potential of the second transistor are set to predetermined fixed potentials. Thus, a variation in the luminous intensity caused by a variation in the threshold voltage of the second transistor is corrected. Since the source-side fixed potential can be set from the signal line, a wiring pattern for a fixed power supply for setting the source side to have the predetermined potential and a scanning line for a control signal for controlling the second transistor to have the fixed potential can be omitted. Consequently, compared with the related art, a reduced number of wiring patterns for scanning lines and for fixed potentials can be achieved.

DESCRIPTION OF THE PREFERRED EMBODIMENTS

Embodiments of the present invention will be described with reference to the drawings.

First Embodiment

Figure 1:
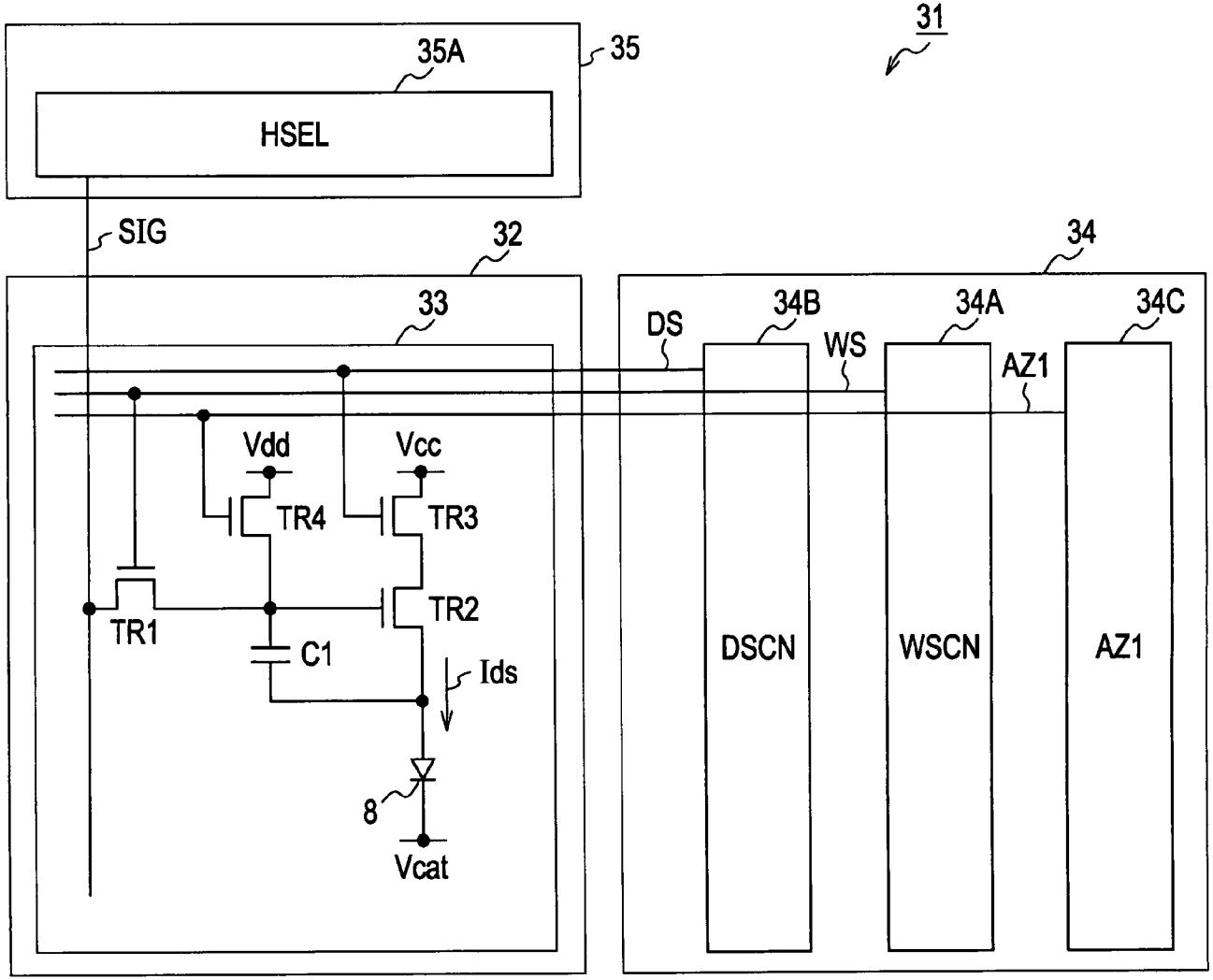
FIG. 1 is block diagram showing a display device according to a first embodiment of the present invention.
Figure 14:
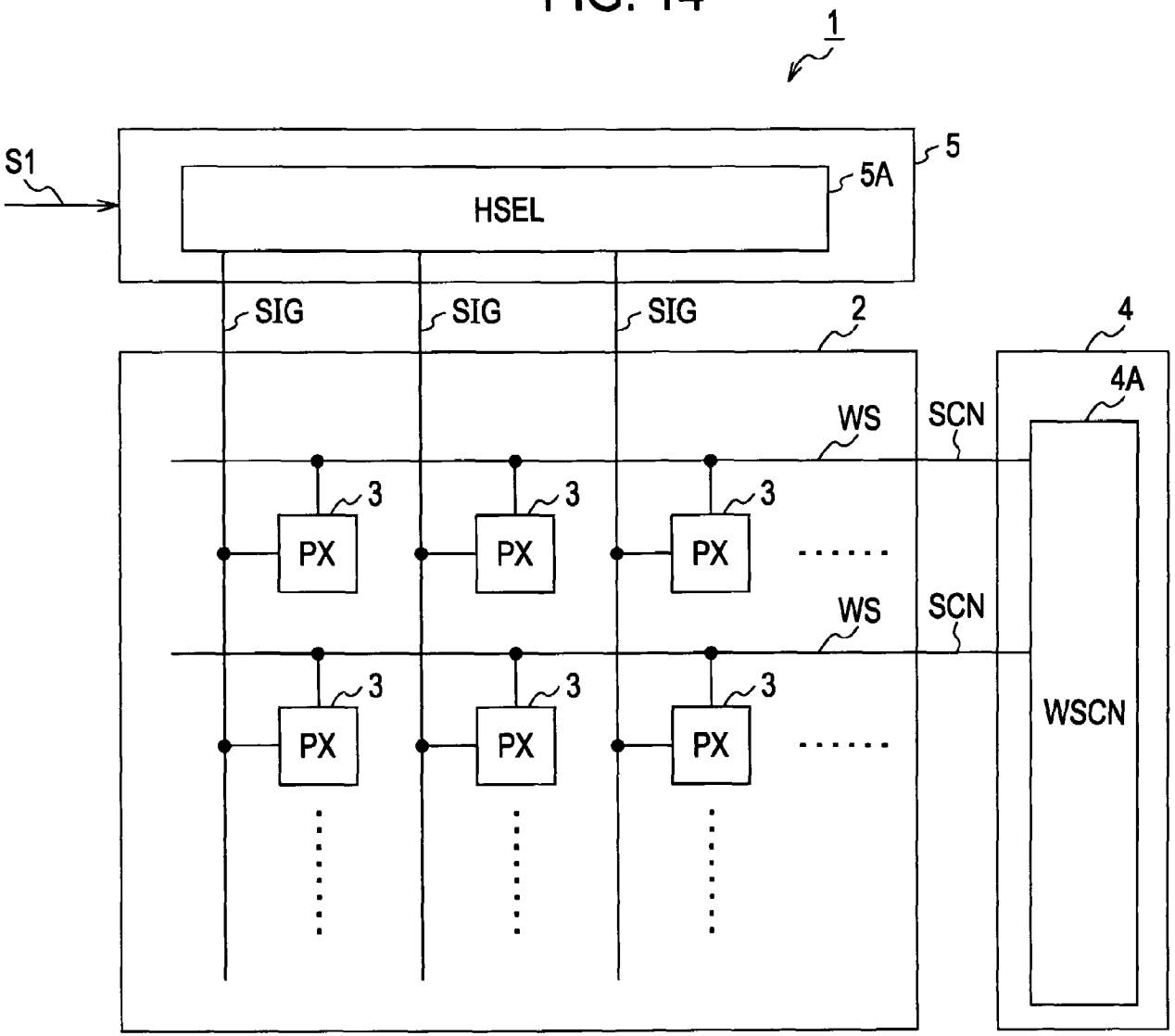
FIG. 14 is a block diagram showing a display device of the related art.
Figure 15:
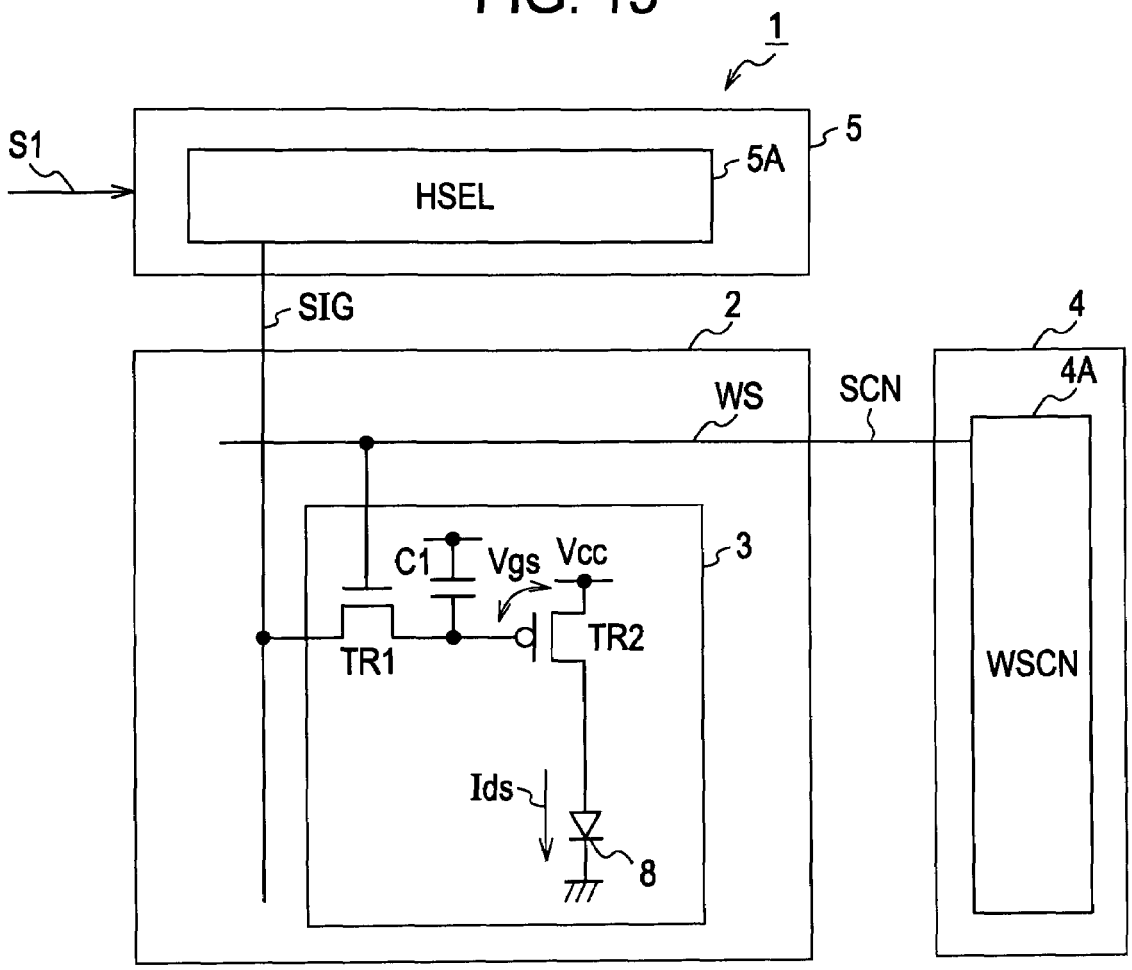
FIG. 15 is a block diagram showing the display device shown in FIG. 14 in detail.
Figure 16:
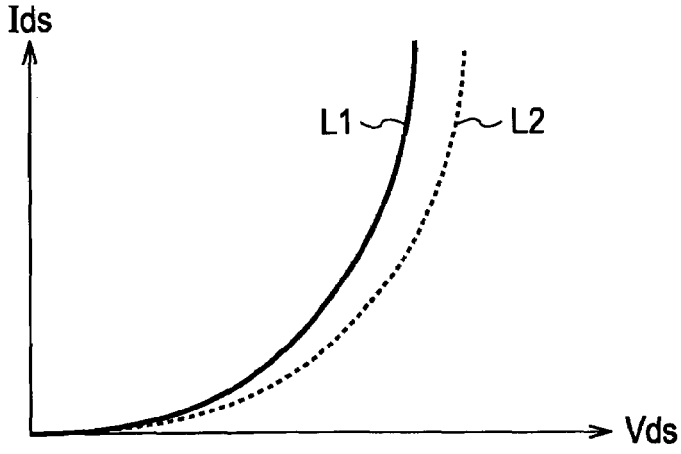
FIG. 16 is a characteristic graph showing a change of an organic EL element with time.
Figure 17:
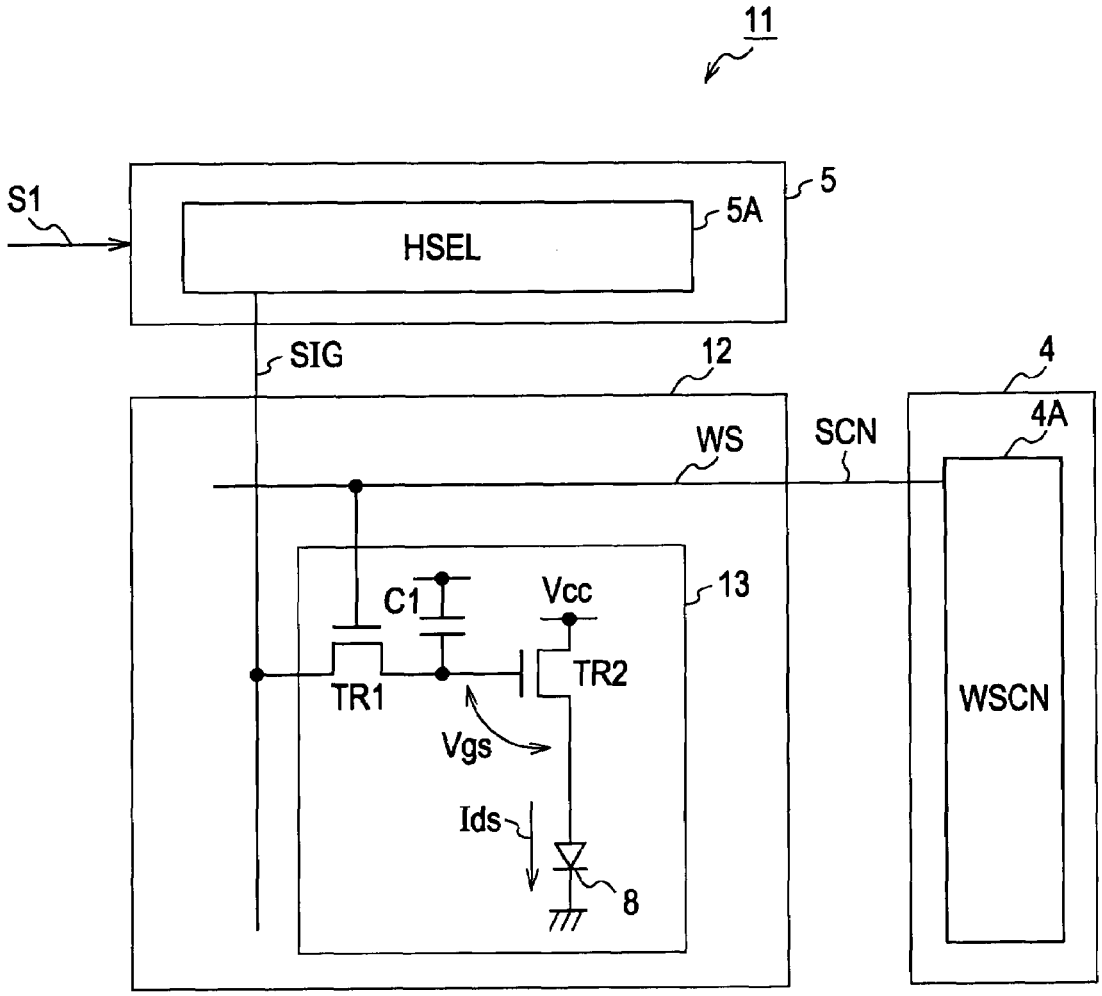
FIG. 17 is a block diagram showing a case where N-channel transistors are used in the configuration shown in FIG. 14.
Figure 18:
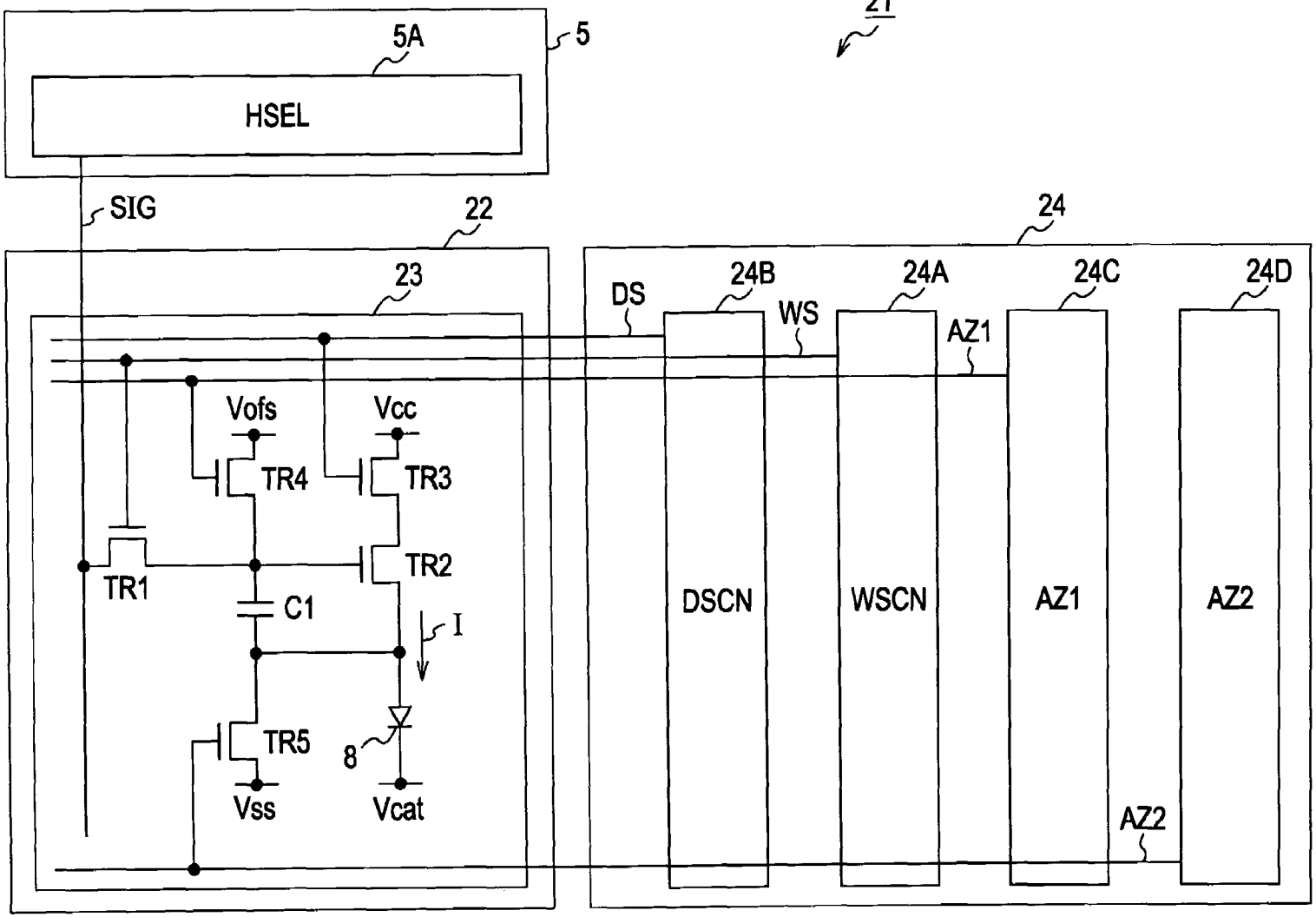
FIG. 18 is a connection diagram showing a display device of the related art using N-channel transistors.
Figure 19:
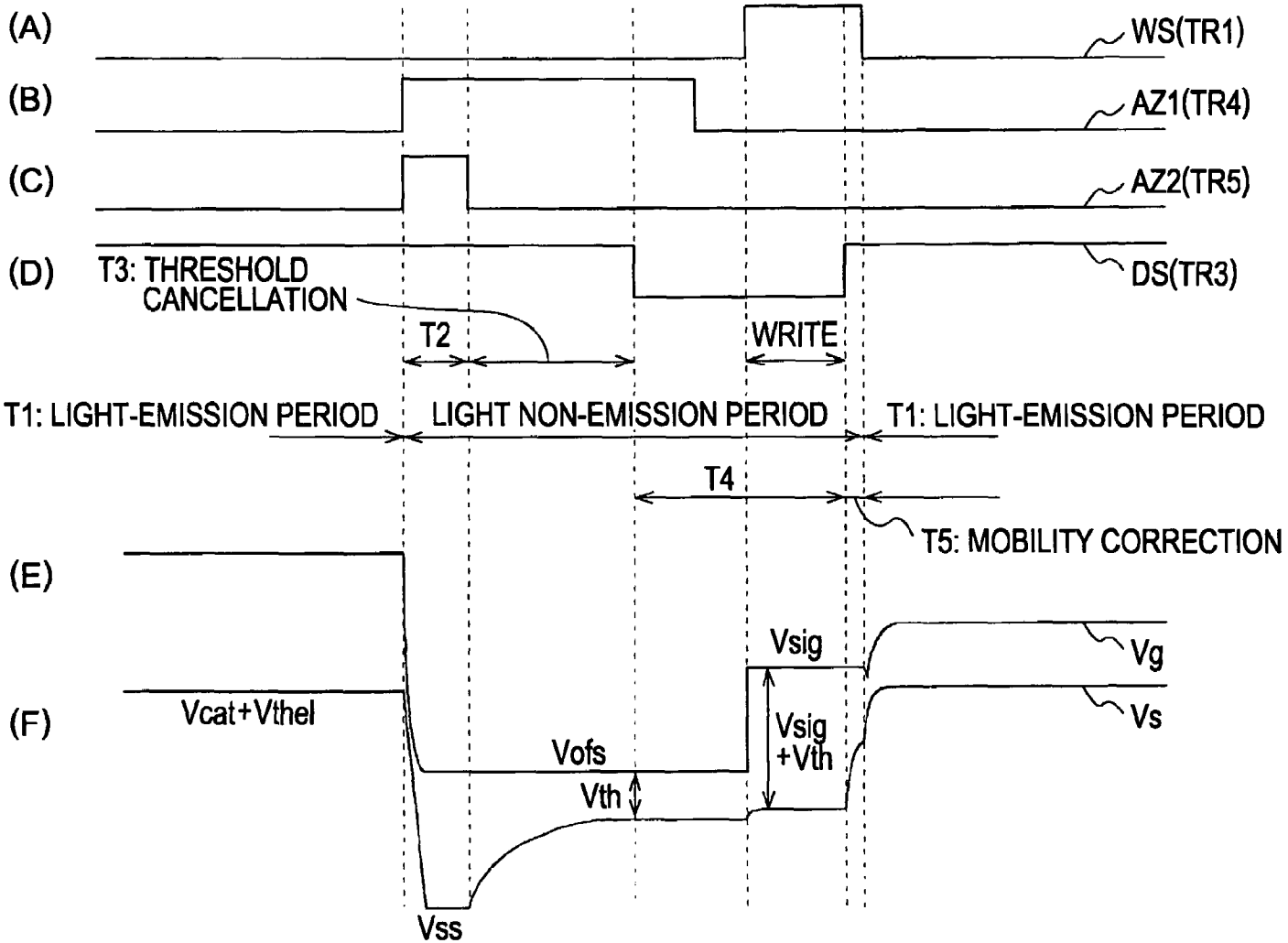
FIG. 19 is a timing chart of the display device shown in FIG. 18.
Figure 20:
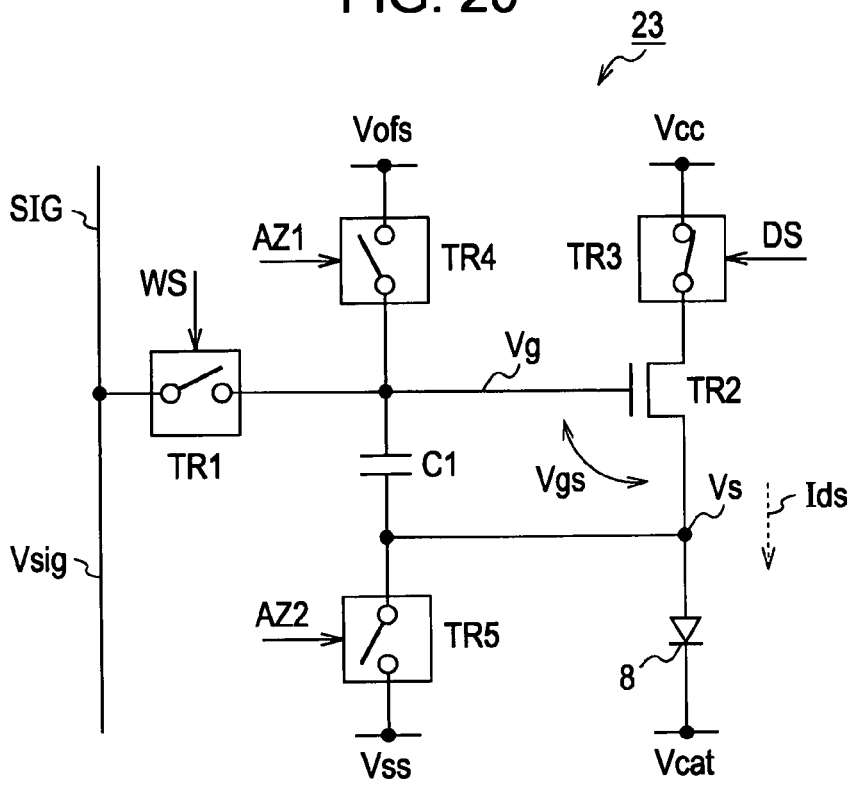
FIG. 20 is a connection diagram illustrating setting of a pixel in a period T1 shown in FIG. 19.
Figure 21:
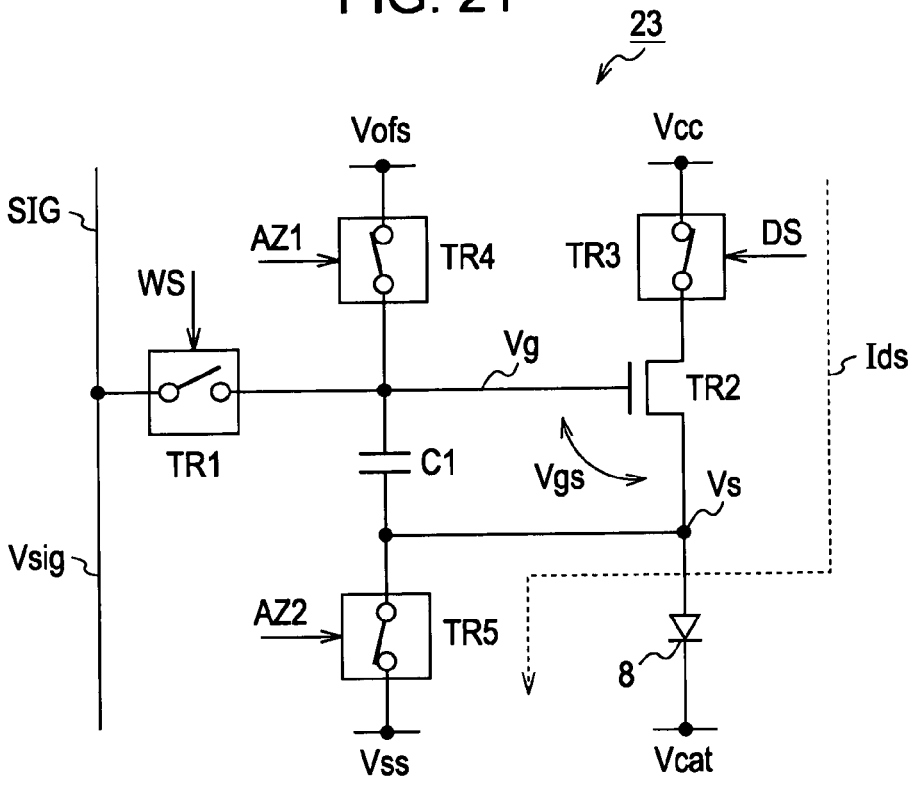
FIG. 21 is a connection diagram illustrating setting of the pixel in a period T2 shown in FIG. 19.
Figure 22:
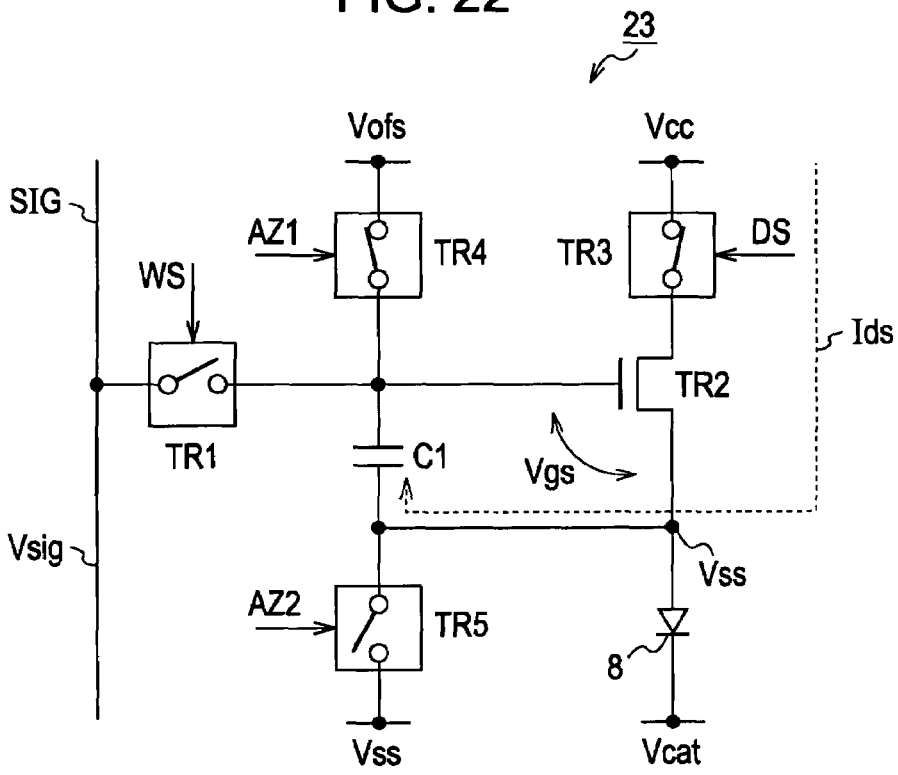
FIG. 22 is a connection diagram illustrating setting of the pixel in a period T3 shown in FIG. 19.
Figure 23:
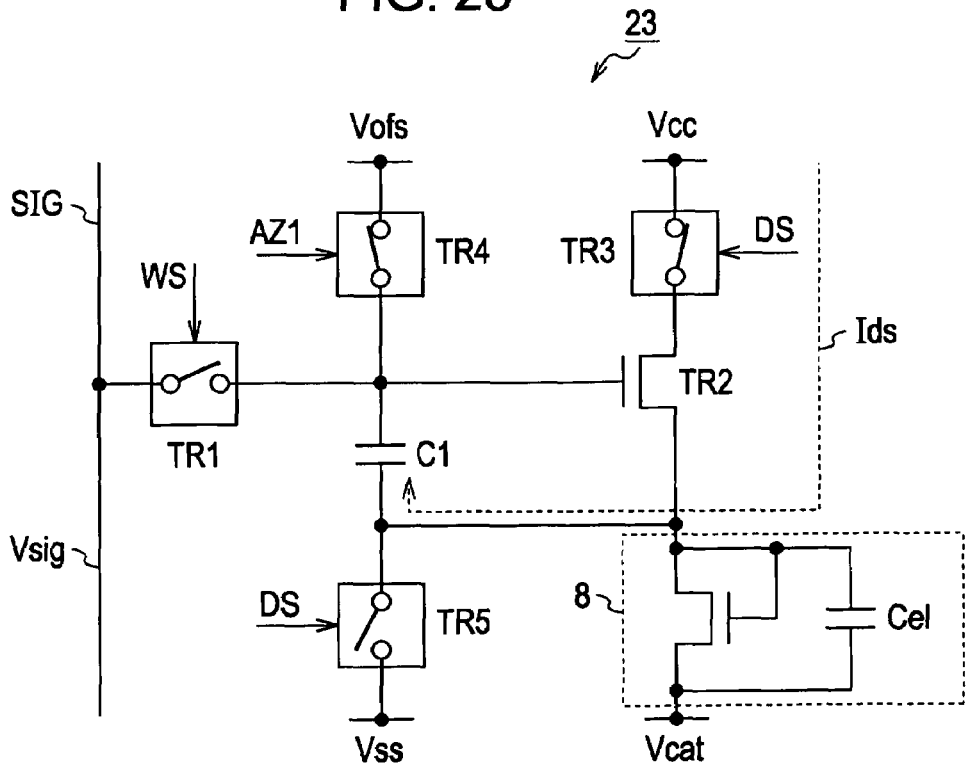
FIG. 23 is a connection diagram illustrating setting subsequent to the state shown in FIG. 22.
Figure 24:
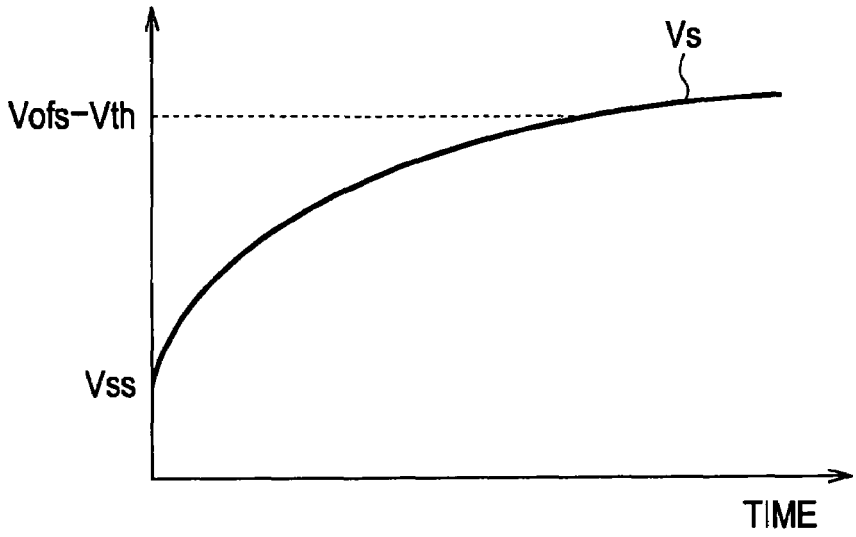
FIG. 24 is a characteristic graph used for explaining the correction of a threshold voltage.
Figure 25:
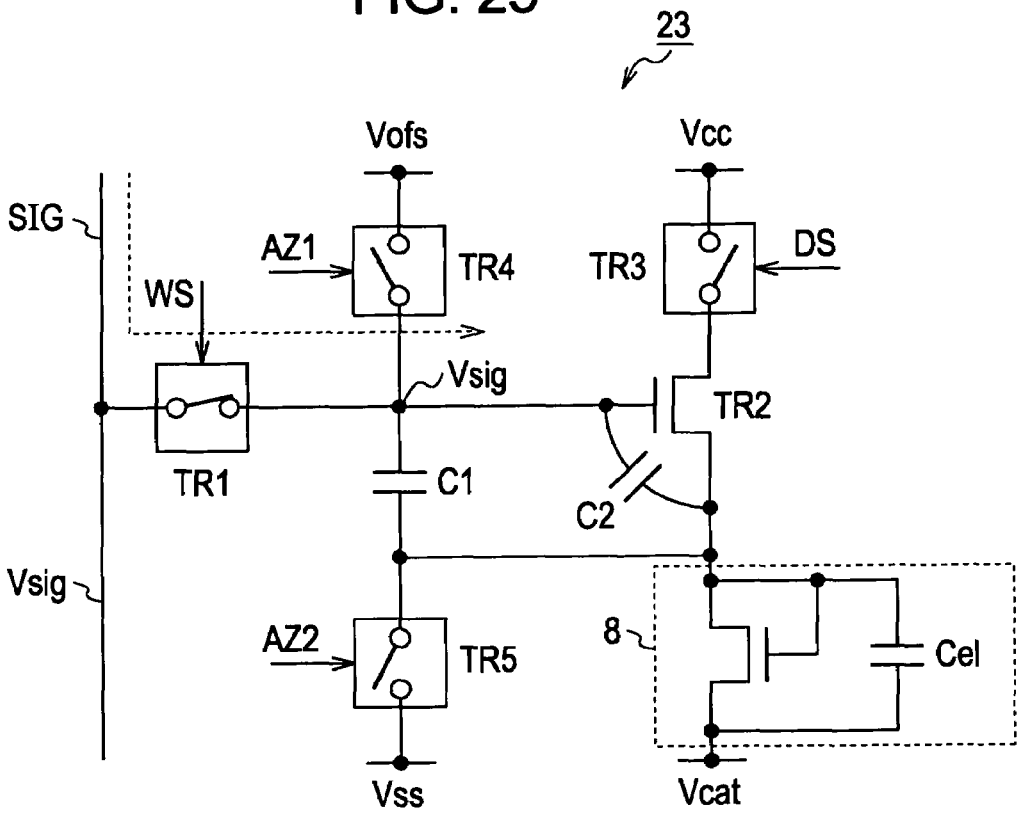
FIG. 25 is a connection diagram illustrating setting of the pixel in a period T4 shown in FIG. 19.
Figure 26:
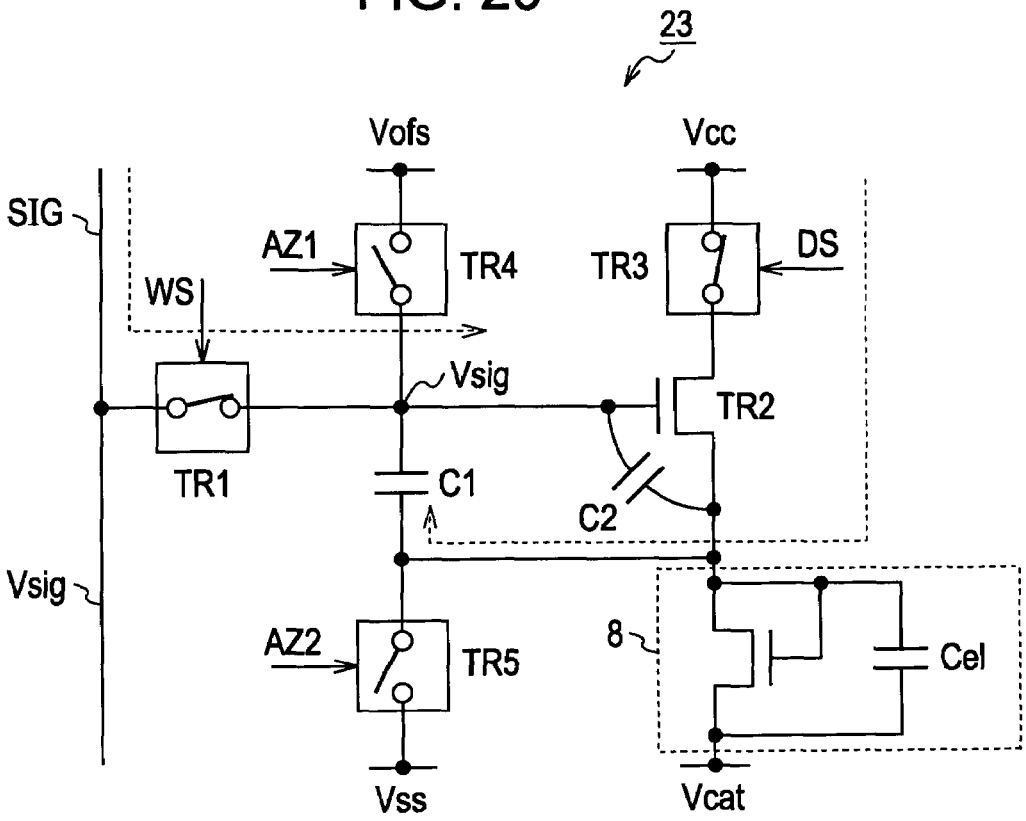
FIG. 26 is a connection diagram illustrating setting of the pixel in a period T5 shown in FIG. 19.
Figure 27:
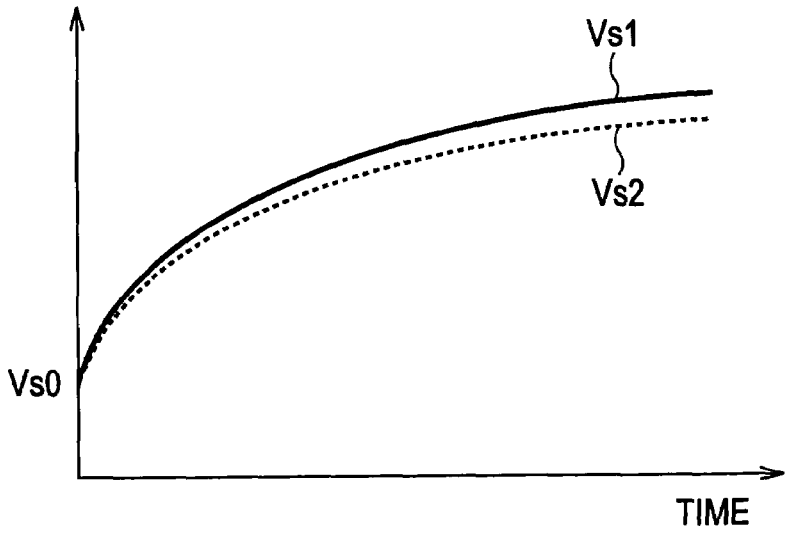
FIG. 27 is a characteristic graph used for explaining the correction of mobility.

FIG. 1 is a block diagram showing a display device according to a first embodiment of the present invention. FIG. 1 is used for comparison with FIG. 18. In the description of a display device 31 shown in FIG. 1, the same parts as in the display devices 1, 11, and 21 described with reference to FIGS. 14, 18, and the like are denoted by the same reference numerals or symbols, and the descriptions of those same parts will not be repeated here. In the display device 31, all the transistors are of the N-channel type. In addition, a pixel area 32, a horizontal driving circuit 35, and a vertical driving circuit 34 are formed integrally with each other on a glass substrate, which is a transparent insulating substrate, by an amorphous-silicon process.

Figure 2:
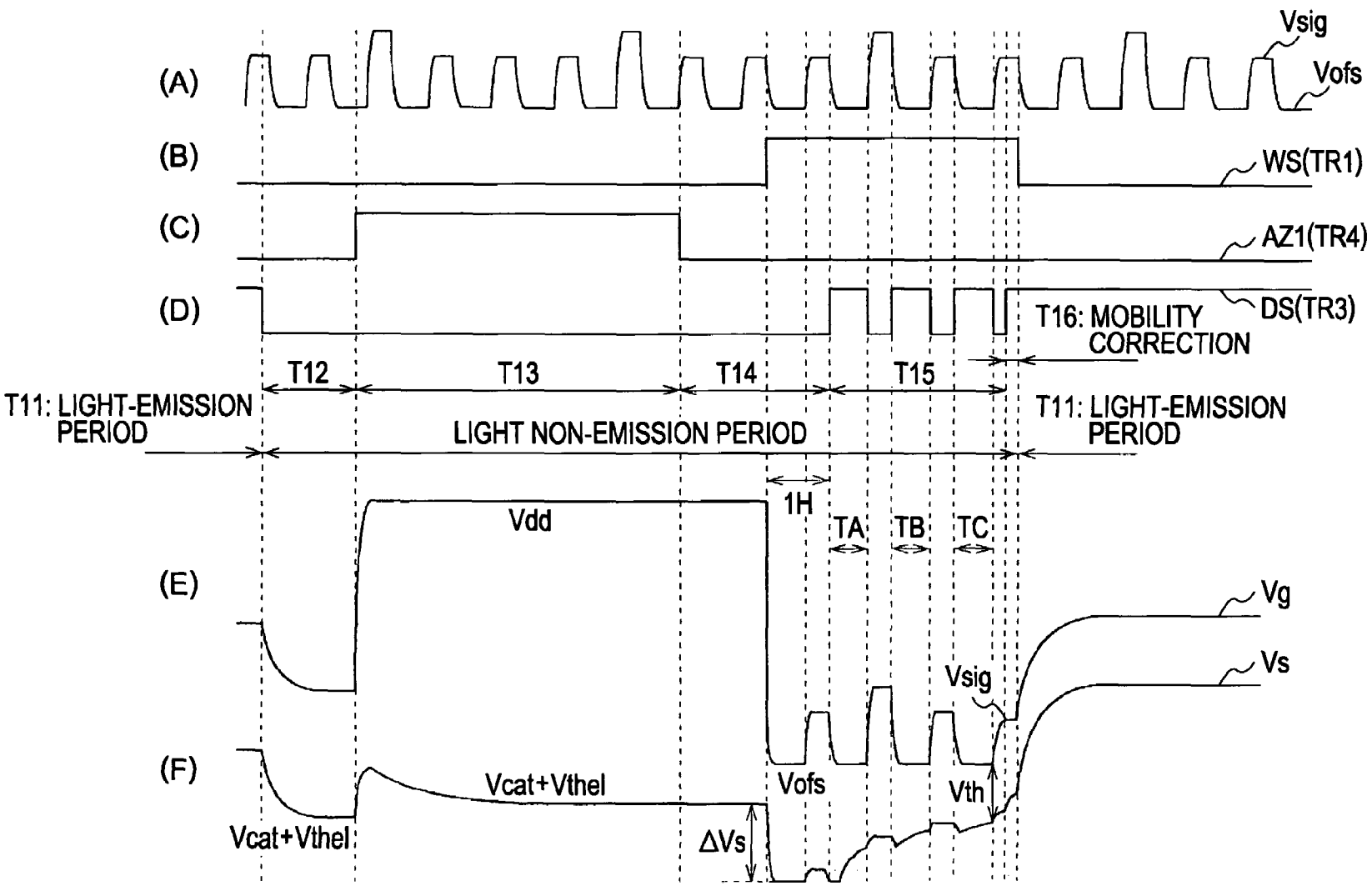
FIG. 2 is a timing chart of the display device shown in FIG. 1.

In the horizontal driving circuit 35, a horizontal selector (HSEL) 35A sequentially transfers predetermined sampling pulses as clock pulses to generate timing signals, and signal lines SIG are set to have the signal level of an input signal S1 on the basis of the timing signals. As shown in FIG. 2, during substantially the first half period of one horizontal scanning period (1H), the signal levels of signal lines SIG are set to the predetermined fixed potential Vofs for the pixel 23, which is described above with reference to FIG. 18, and then, during substantially the last half period of the one horizontal scanning period, the signal levels of the signal lines SIG are sequentially set to signal levels Vsig corresponding to the grayscale levels of corresponding pixels 33 connected to the signal lines SIG (see part (A) of FIG. 2). In FIG. 2, symbols representing transistors that are turned on and off in accordance with corresponding signals are represented together with the corresponding signals.

The vertical driving circuit 34 does not include a control-signal generation circuit AZ2 for outputting a control signal AZ2. In the vertical driving circuit 34, a write scan circuit (WSCN) 34A, a drive scan circuit (DSCN) 34B, and a control-signal generation circuit 34C generate a write signal WS, a driving-pulse signal DS, and a control signal AZ1, respectively.

In the pixel area 32, a plurality of pixels 33 are arranged in a matrix. In each of the pixels 33, one end of a signal-level holding capacitor C1 is connected to the anode of an organic EL element 8, and the other end of the signal-level holding capacitor C1 is connected to a corresponding signal line SIG through a transistor TR1, which is turned on and off in accordance with a write signal WS. Thus, in the pixel 33, the voltage at the other end of the signal-level holding capacitor C1 is set to the signal level of the signal line SIG in accordance with the write signal WS.

In the pixel 33, the ends of the signal-level holding capacitor C1 are connected to the source and the gate of a transistor TR2. The drain of the transistor TR2 is connected to a power supply Vcc through a transistor TR3, which is turned on and off in accordance with a driving-pulse signal DS. Thus, in the pixel 33, the transistor TR2, which has a source-follower circuit configuration where the gate potential is set to the signal level of the signal line SIG, drives the organic EL element 8.

In addition, in the pixel 33, the base of the transistor TR2 is connected to a fixed potential Vdd through a transistor TR4, which is turned on and off in accordance with a control signal AZ1. Here, the fixed potential Vdd is set to a sufficiently high level in the pixel 33. In the first embodiment, the drain of the transistor TR4 is connected to the fixed potential Vdd, and the fixed potential Vdd is set to the potential of the power supply Vcc.

Figure 3:
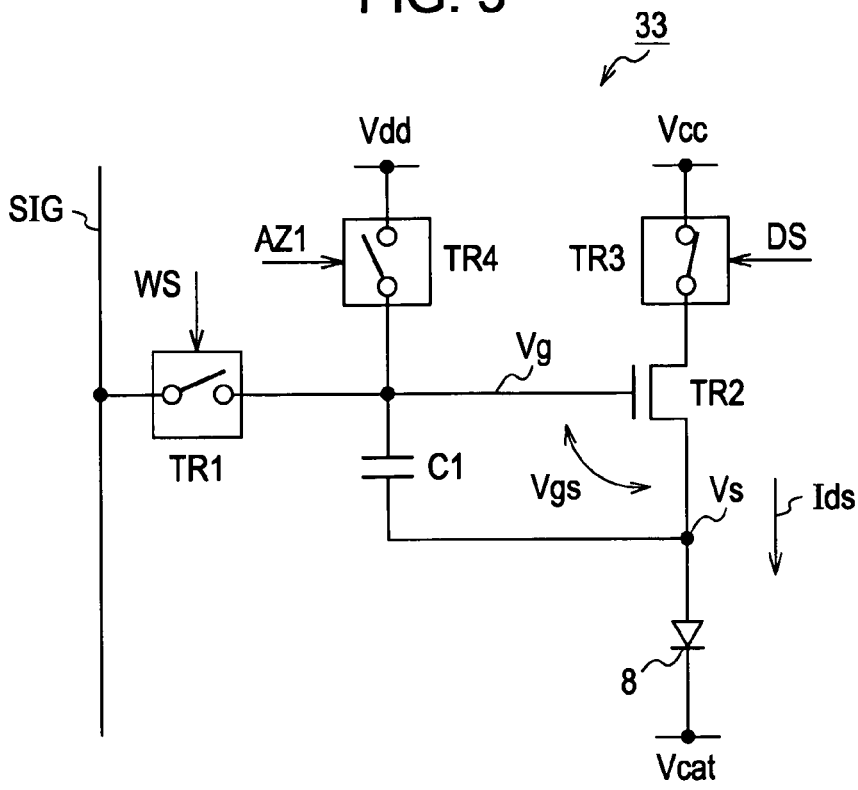
FIG. 3 is a connection diagram illustrating setting of a pixel in a period T11 shown in FIG. 2.

As shown in FIG. 3, in a light-emission period T11 where the organic EL element 8 emits light, in the pixel 33, a write signal WS and a control signal AZ1 exhibit a low level (see parts (B) and (C) of FIG. 2) so that the transistors TR1 and TR4 are set to be off, and a driving-pulse signal DS exhibits a high level (see part (D) of FIG. 2) so that the transistor TR3 is set to be on. The pixel 33 is set such that the transistor TR2 operates in a saturation region in this state.

Thus, in the pixel 33, the transistor TR2 and the signal-level holding capacitor C1 form a constant-current circuit corresponding to a gate-source voltage Vgs, which is based on the potential difference across the signal-level holding capacitor C1, and the organic EL element 8 emits light in accordance with a drain-source current Ids, which is determined on the basis of the gate-source voltage Vgs. Thus, the display device 31 prevents a reduction in the luminous intensity that can be caused by a change of the organic EL element 8 with time. The drain-source current Ids is represented by expression (1).

Figure 4:
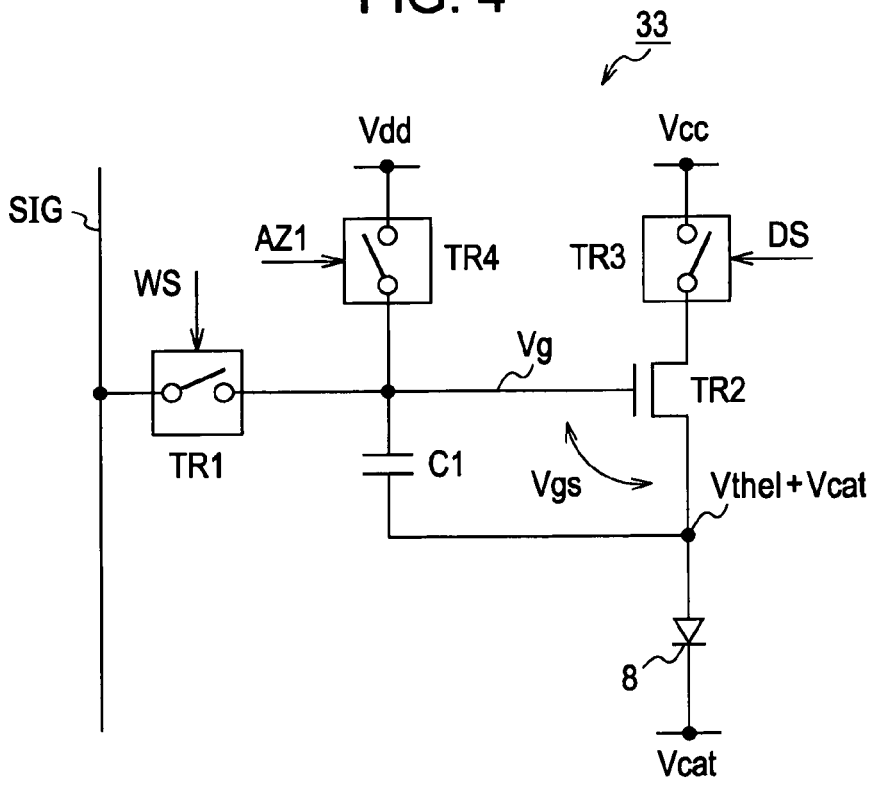
FIG. 4 is a connection diagram illustrating setting of the pixel in a period T12 shown in FIG. 2.

Then, in the subsequent period T12, in the pixel 33, the driving-pulse signal DS exhibits a low level, so that the transistor TR3 is set to be off, as shown in FIG. 4. Thus, in the period T12, the supply of the power supply Vcc to the transistor TR2 is stopped, and the organic EL element 8 stops emitting light. In addition, an electric charge stored as a parasitic capacitance Cel of the organic EL element 8 is discharged, and the source voltage Vs of the transistor TR2 gradually decreases. Thus, the source voltage Vs of the transistor TR2 is set to a voltage (Vcat+Vthel), which is obtained by adding a threshold voltage Vthel of the organic EL element 8 to the cathode potential Vcat of the organic EL element 8.

Figure 5:
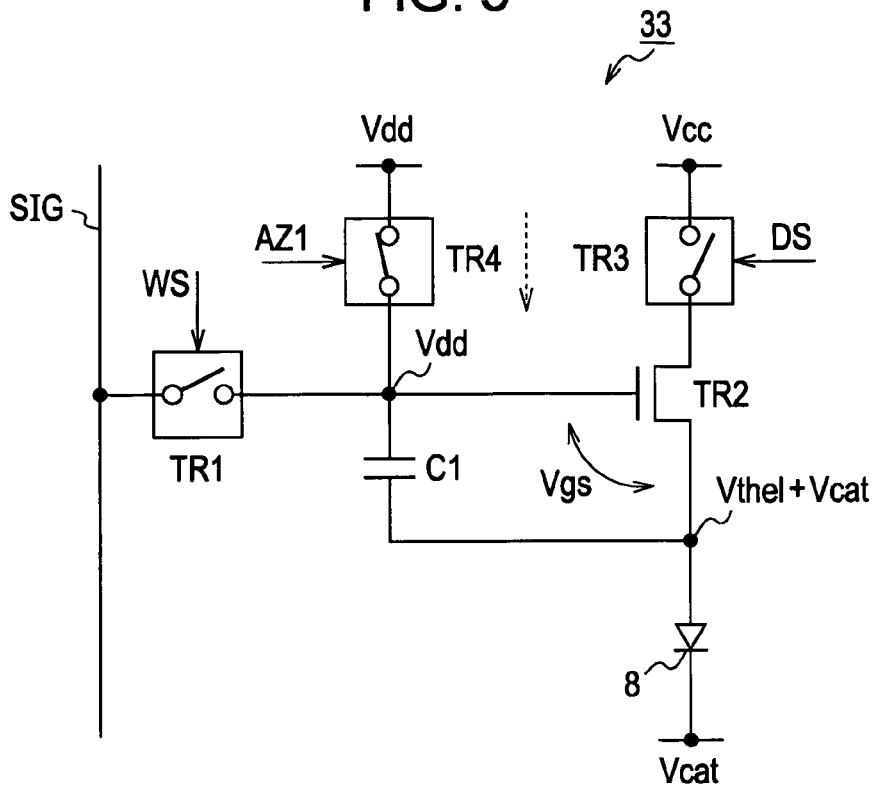
FIG. 5 is connection diagram illustrating setting of the pixel in a period T13 shown in FIG. 2.

Then, in the subsequent period T13, in the pixel 33, the control signal AZ1 exhibits a high level, so that the transistor TR4 is set to be on, as shown in FIG. 5. Thus, in the pixel 33, the voltage at the end of the signal-level holding capacitor C1 closer to the transistor TR4 rises to the fixed potential Vdd. Since the fixed potential Vdd is equal to the power-supply voltage Vcc, although the source voltage Vs of the transistor TR2 temporarily increases in conjunction with the rising of the fixed potential Vdd, the source voltage Vs of the transistor TR2 then gradually decreases to the voltage (Vcat+Vthel).

Figure 6:
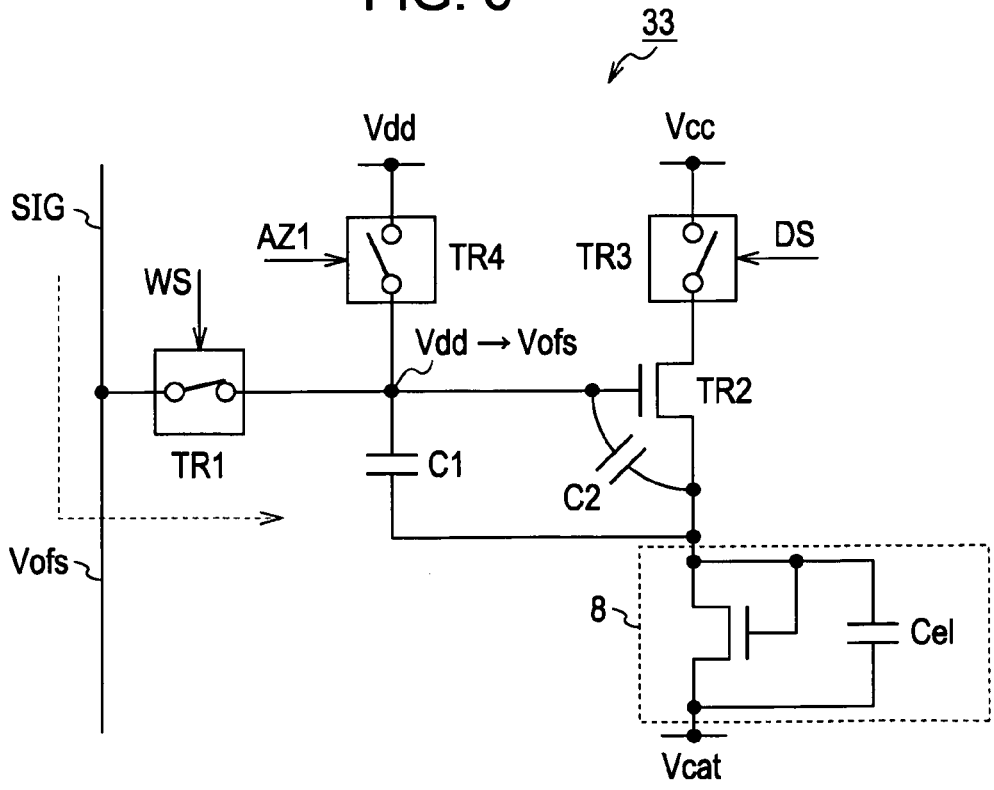
FIG. 6 is a connection diagram illustrating setting of the pixel in a period T14 shown in FIG. 2.

In the subsequent period T14, in the pixel 33, after the signal level of the control signal AZ1 drops to the low level so that the transistor TR4 is set to be off, in a period when the signal level of the signal line SIG is set to the fixed potential Vofs, the write signal WS rises to the high level so that the transistor TR1 is set to be on, as shown in FIG. 6. Thus, in the pixel 33, the gate voltage Vg of the transistor TR2 drops to the signal level Vofs of the signal line SIG. Since the change in the gate voltage Vg is in a direction in which the signal level drops, the source voltage Vs of the transistor TR2 changes in a direction in which the organic EL element 8 is reversely biased due to the coupling among the capacitance of the signal-level holding capacitor C1, the parasitic capacitance Cel of the organic EL element 8, and the gate-source capacitance C2. More specifically, as represented by expressions (4) and (5), the source voltage Vs of the transistor TR2 drops by the amount corresponding to a value obtained by dividing the change in the gate voltage Vg by the capacitance of the signal-level holding capacitor C1, the parasitic capacitance Cel of the organic EL element 8, and the gate-source capacitance C2 of the transistor TR2. Here, "ΔVs" represents a change in the source voltage Vs due to a change in the gate voltage Vg, and "Vgs" represents the gate-source voltage of the transistor TR2 due to the voltage change.

$$\Delta Vs = \frac{C1 + C2}{Cel + C1 + C2} \times (Vofs - Vdd) \tag{4}$$

$$Vgs = \frac{Cel}{Cel + C1 + C2} \times Vofs + \frac{C1 + C2}{Cel + C1 + C2} \times Vdd - Vcat - Vthel \tag{5}$$

Figure 7:
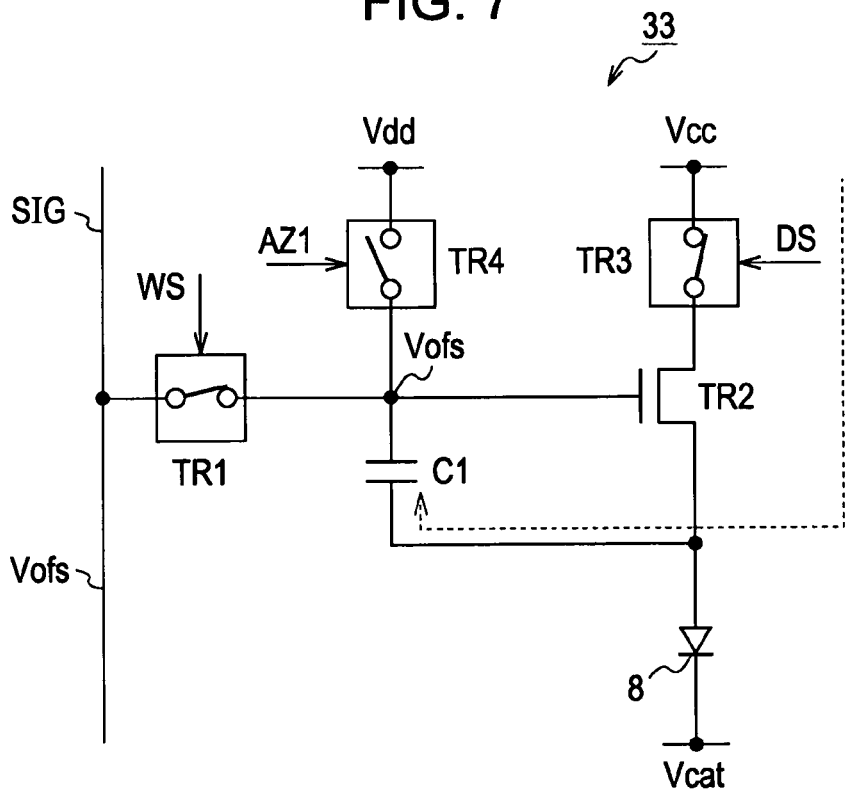
FIG. 7 is a connection diagram illustrating setting subsequent to the state shown in FIG. 6.

Then, in the subsequent period T15, in the pixel 33, the driving-pulse signal DS rises to the high level, so that the transistor TR3 is set to be on, as shown in FIG. 7, at the beginning of a period in which the signal line SIG has the fixed potential Vofs, and the time being a predetermined number of horizontal scanning periods backward from the starting of the light-emission period T11. Thus, in the pixel 33, a current flows as represented by an arrow, and the source voltage Vs of the transistor TR2 gradually increases in a direction in which the potential difference across the signal-level holding capacitor C1 changes to the threshold voltage Vth of the transistor TR2.

In the pixel 33 in the state shown in FIG. 7, the expression Vel≦Vcat+Vthel is satisfied, and the potential Vel is set to be a voltage corresponding to a very small current compared with the drain-source current Ids of the transistor TR2. Thus, the drain-source current Ids of the transistor TR2 is used to charge the signal-level holding capacitor C1 and the capacitance of the organic EL element 8, and the organic EL element 8 is maintained in a state where the organic EL element 8 stops emitting light.

Figure 8:
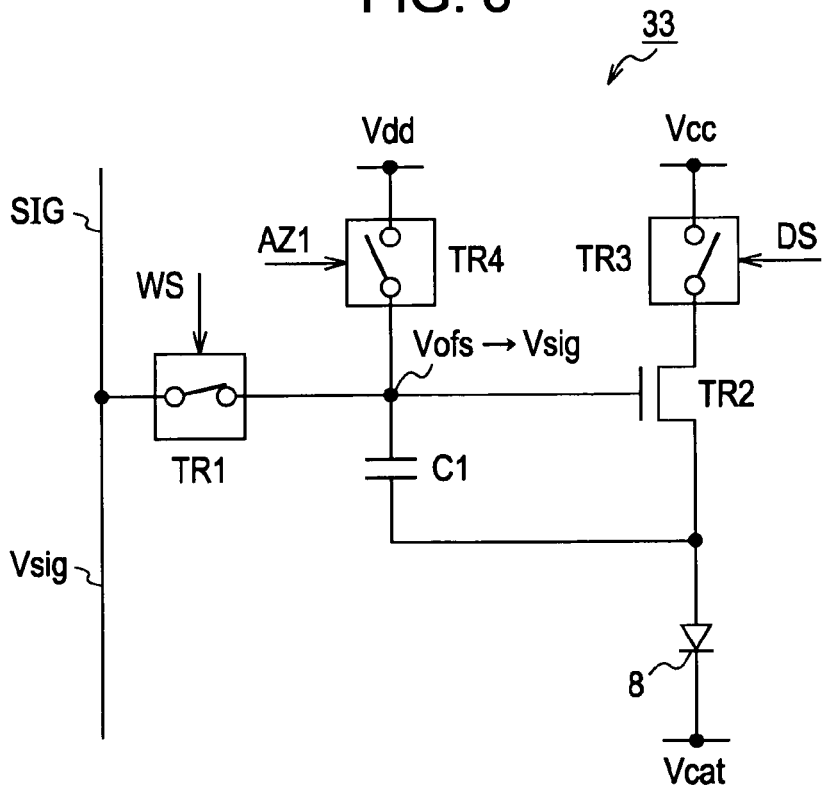
FIG. 8 is a connection diagram illustrating setting subsequent to the state shown in FIG. 7.

Then, in the pixel 33, at a time when the signal level of the signal line SIG rises to the signal level Vsig of a corresponding a grayscale level, the signal level of the driving-pulse signal DS drops to the low level. As a result, as shown in FIG. 8, the transistor TR3 is set to be off, and the gate voltage Vg of the transistor TR2 rises from the voltage Vofs to the signal level Vsig corresponding to the grayscale level of the pixel preceding the current pixel by a predetermined number of lines. In this case, in the pixel 33, the expression Vel≦Vcat+Vthel is satisfied, and the organic EL element 8 is maintained in a state where the organic EL element 8 stops emitting light. In addition, a change in the source voltage Vs of the transistor TR2 is represented by expression (6).

$$\Delta Vs = \frac{C1 + C2}{Cel + C1 + C2} \times (Vsig - Vofs) \tag{6}$$

After a predetermined period of time has elapsed, the signal level of the signal line SIG is set to the fixed potential Vofs again, and the fixed potential Vofs is input to the gate of the transistor TR2. In this case, a change in the source voltage Vs of the transistor TR2 is represented by expression (7).

$$\Delta Vs = \frac{C1 + C2}{Cel + C1 + C2} \times (Vofs - Vsig) \quad (7)$$

In the pixel 33, the state shown in FIG. 7 where the driving-pulse signal DS exhibits the high level and the state shown in FIG. 8 where the driving-pulse signal DS exhibits the low level are repeated a predetermined number of times. The source voltage Vs of the transistor TR2 gradually increases, and the potential difference across the signal-level holding capacitor C1 is set to the threshold voltage Vth of the transistor TR2. Thus, the anode potential Vel of the organic EL element 8 is set so as to satisfy the expression Vel=Vofs−Vth≦Vcat+Vthel.

Figure 9:
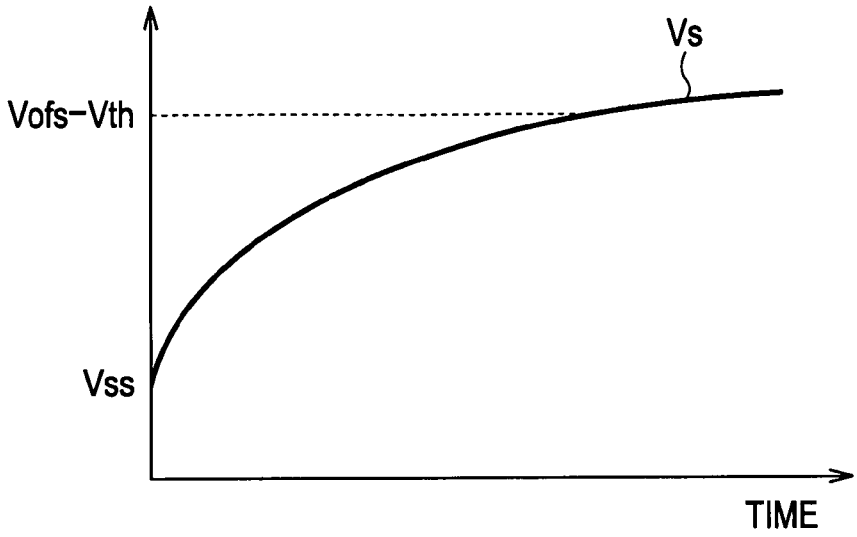
FIG. 9 is a characteristic graph used for explaining the correction of a threshold voltage.

Accordingly, in the example shown in FIG. 2, in periods TA, TB, and TC, the potential difference across the signal-level holding capacitor C1 is set to the threshold voltage Vth of the transistor TR2. FIG. 9 is a characteristic graph showing a change in the source voltage of the transistor TR2 in a case where the signal level of the signal line SIG and the driving-pulse signal DS are set to the fixed potential Vofs for a long period of time. Finally, the gate-source voltage Vgs of the transistor TR2 reaches the potential Vth. Accordingly, the display device 31 is set such that the states shown in FIGS. 7 and 8 are repeated a sufficient number of times for setting the potential difference across the signal-level holding capacitor C1 to the threshold voltage Vth of the transistor TR2.

Figure 10:
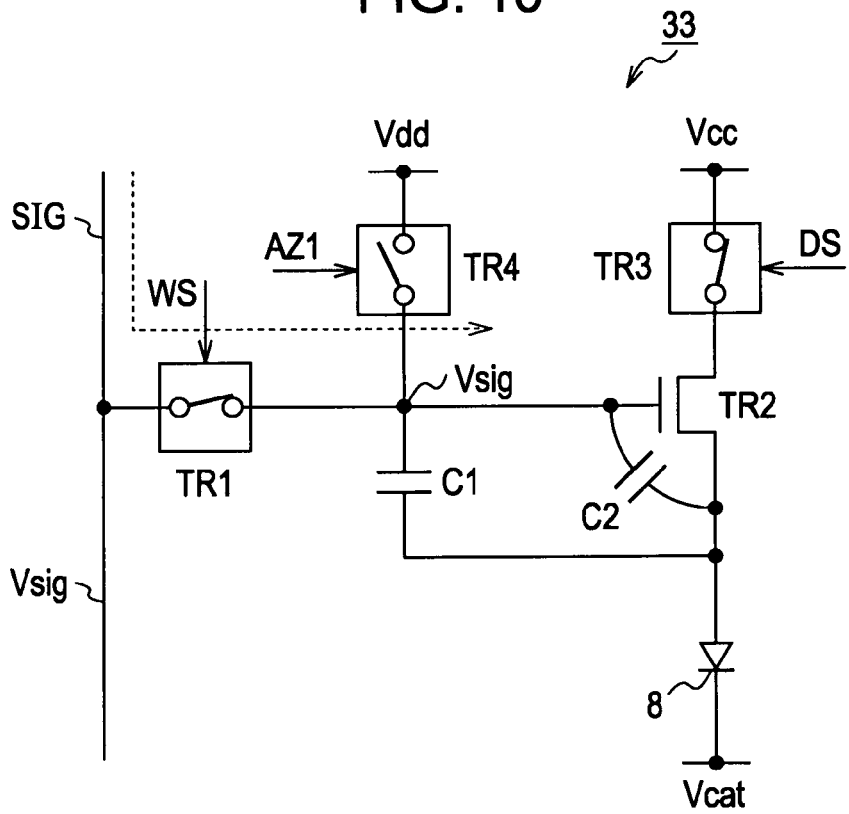
FIG. 10 is a connection diagram illustrating setting of the pixel in a period T15 shown in FIG. 2.

As described above, the signal-level holding capacitor C1 is set to have the threshold voltage Vth of the transistor TR2. Then, in the subsequent period T16, in the pixel 33, in a period in which the signal level of the signal line SIG is set to the signal level Vsig of a corresponding pixel, the signal level of the driving-pulse signal DS rises to the high level, so that the transistor TR3 is set to be on, as shown in FIG. 10. Then, the signal level of the write signal WS drops to the low level, so that the transistor TR1 is set to be off. Thus, the signal level Vsig of the signal line SIG at the immediately previous time when the transistor TR1 is turned on is sampled and held by the signal-level holding capacitor C1. Then, the connection state shown in FIG. 3 is returned.

When a signal is input, the gate-source voltage Vgs of the transistor TR2 is accurately represented by expression (2). However, since the parasitic capacitance Cel of the organic EL element 8 is larger than the capacitance of the signal-level holding capacitor C1 and the gate-source capacitance C2 of the transistor TR2, the gate-source voltage Vgs of the transistor TR2 can be set to the voltage (Vsig+Vth) with a sufficient accuracy.

Figure 11:
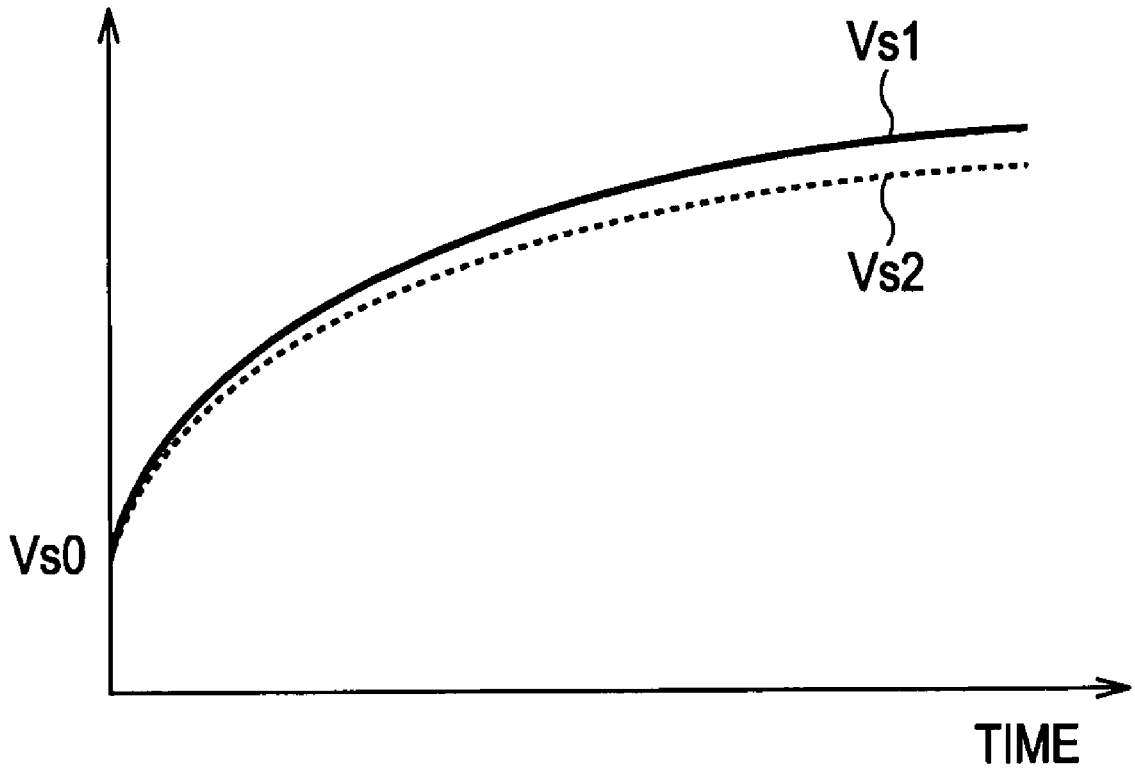
FIG. 11 is a characteristic graph used for explaining the correction of mobility.

In the period T16, in the pixel 33, the transistor TR1 is maintained on and the transistor TR3 is set to be on. As shown in FIG. 11, the source voltage Vs of the transistor TR2 changes in accordance with the mobility of the transistor TR2. Thus, a variation in the luminous intensity that can be caused by a variation in the mobility of the transistor TR2 is prevented. As shown in FIG. 11, where "Vs1" represents a case of a large mobility and "Vs2" represents a case of a small mobility, the larger the mobility, the higher the speed of the increase in the source voltage Vs.

Operations of Embodiment

With the configuration described above, in the display device 31 (see FIG. 2), due to the driving of scanning lines by the vertical driving circuit 34, the signal levels of signal lines SIG are sequentially set to pixels 33 in individual lines in the pixel area 32, and the pixels 33 emit light in accordance with the set signal levels. Thus, a desired image is displayed in the pixel area 32.

That is, in the display device 31, when the transistor TR1 is turned on, the signal-level holding capacitor C1 is set to have the signal level of the signal line SIG. In addition, when the transistors TR1 and TR4 are set to be off and the transistor TR3 is set to be on, the transistor TR2 causes the organic EL element 8 to emit light in accordance with the voltage set for the signal-level holding capacitor C1 (see the period T11 in FIG. 2).

In the display device 31, each of the pixels 33 is formed such that the ends of the signal-level holding capacitor C1 are connected to the gate and the source of the transistor TR2, which drives the organic EL element 8, and the source of the transistor TR2 is connected to the anode of the organic EL element 8. Thus, in the display device 31, after the signal-level holding capacitor C1 is set to have the signal level of the signal line SIG, the organic EL element 8 is driven by the gate-source voltage Vgs corresponding to the potential difference across the signal-level holding capacitor C1. Thus, even in a case where all the transistors forming the display device 31 are of the N-channel type, a reduction in the luminous intensity that can be caused by a change of the organic EL element 8 with time is prevented.

In the case of stopping a light emission of the organic EL element 8 and setting the signal-level holding capacitor C1 to have the signal level of the signal line SIG, the source voltage Vs and the gate voltage Vg of the transistor TR2, which drives the organic EL element 8, are temporarily set to predetermined potentials by controlling switching of the transistors TR1, TR3, and TR4. Then, the source voltage Vs gradually increases such that the potential difference across the signal-level holding capacitor C1 is set to the threshold voltage Vth of the transistor TR2 (see periods TA, TB, and TC in FIG. 2). Then, the signal-level holding capacitor C1 is set to have the signal level Vsig of the signal line SIG. Thus, a variation in the luminous intensity that can be caused by a variation in the threshold voltage Vth, which is a characteristic of the transistor TR2, is prevented.

However, in a case where the signal-level holding capacitor C1 is set to have the threshold voltage Vth of the transistor TR2 as described above, it is necessary to set the gate and the source of the transistor TR2 to have predetermined potentials at predetermined times. Thus, three wiring patterns for fixed potentials including the power-supply voltage Vcc are necessary. Here, a wiring pattern for the cathode voltage Vcat of the organic EL element 8 is eliminated (see FIG. 18). In addition, the number of scanning lines is increased.

In the display device 31, the transistor TR2 is disconnected from the power supply Vcc and the voltage at the source of the transistor TR2 is maintained at a predetermined potential (Vcat+Vthel). In this state, the transistor TR4 is set to be on in accordance with the control signal AZ1, and the gate voltage Vg of the transistor TR2 increases to the fixed potential Vdd.

In addition, after the signal level of the signal line SIG is alternately set to the fixed potential Vofs and to a signal level indicating the grayscale level of the pixel and the transistor TR4 is set to be off, in a period when the signal level of the signal line SIG is set to the fixed potential Vofs, the transistor TR1 is turned on in accordance with the write signal WS, and the gate voltage Vg of the transistor TR2 is set to the fixed potential Vofs. At this time, due to the coupling among the signal-level holding capacitor C1, the gate-source capacitance C2 of the transistor TR2, and the parasitic capacitance Cel of the organic EL element 8, the source voltage Vs of the transistor TR2 decreases to a predetermine potential.

Thus, in the display device 31, the fixed potential at the source of the transistor TR3 can be set from the signal line SIG. Thus, a wiring pattern for the source-side fixed potential ("Vss" in FIG. 18) can be omitted. Thus, compared with the related art, the number of wiring patterns for fixed potentials can be reduced. In addition, a transistor TR5 for the source-side fixed potential and a control signal AZ2 for turning on and off the transistor TR5 can be omitted (see FIG. 18). Thus, the number of scanning lines can be reduced, and the configuration of the pixels 33 can be simplified. Consequently, since the pixels 33 can be arranged efficiently with high density in the display device 31, a high-precision display device can be provided with a high yield rate.

In addition, in the display device 31, since the fixed potential Vdd, which is set for the gate of the transistor TR2 in accordance with the control signal AZ1, is equal to the power supply voltage Vcc, a wiring pattern for the fixed potential Vdd can be omitted. Thus, the configuration of the pixels 33 can be simplified. Furthermore, the pixels 33 are efficiently arranged with high density, and a high-precision display device can be provided with a high yield rate.

In addition, for the start of the light-emission period T11, after the driving-pulse signal DS rises, the write signal WS drops. Thus, a variation in the luminous intensity that can be caused by a variation in the mobility, which is a characteristic of the transistor TR2, is prevented.

Advantages of Embodiment

With the above-described configuration, the gate voltage and the source potential of a transistor for driving a light-emitting element are set to predetermined fixed potentials so that a variation in luminous intensity caused by a variation in the threshold voltage of the transistor can be corrected, and the source of the transistor is set to have the fixed potential from a signal line SIG. Thus, compared with the related art, a reduced number of scanning lines and a reduced number of wiring patterns for fixed potentials can be achieved.

In addition, after the transistor TR3 is turned on in accordance with the driving-pulse signal DS and a predetermined period of time has elapsed, the transistor TR1 is turned off in accordance with the write signal WS. Thus, a variation in the luminous intensity that can be caused by a variation in the mobility of the transistor TR2 is prevented.

In addition, since all the transistors in pixel circuits and driving circuits are of the N-channel type and are formed on an insulating substrate by an amorphous silicon process, a display device can be manufactured by a simple process.

Second Embodiment

Figure 12:
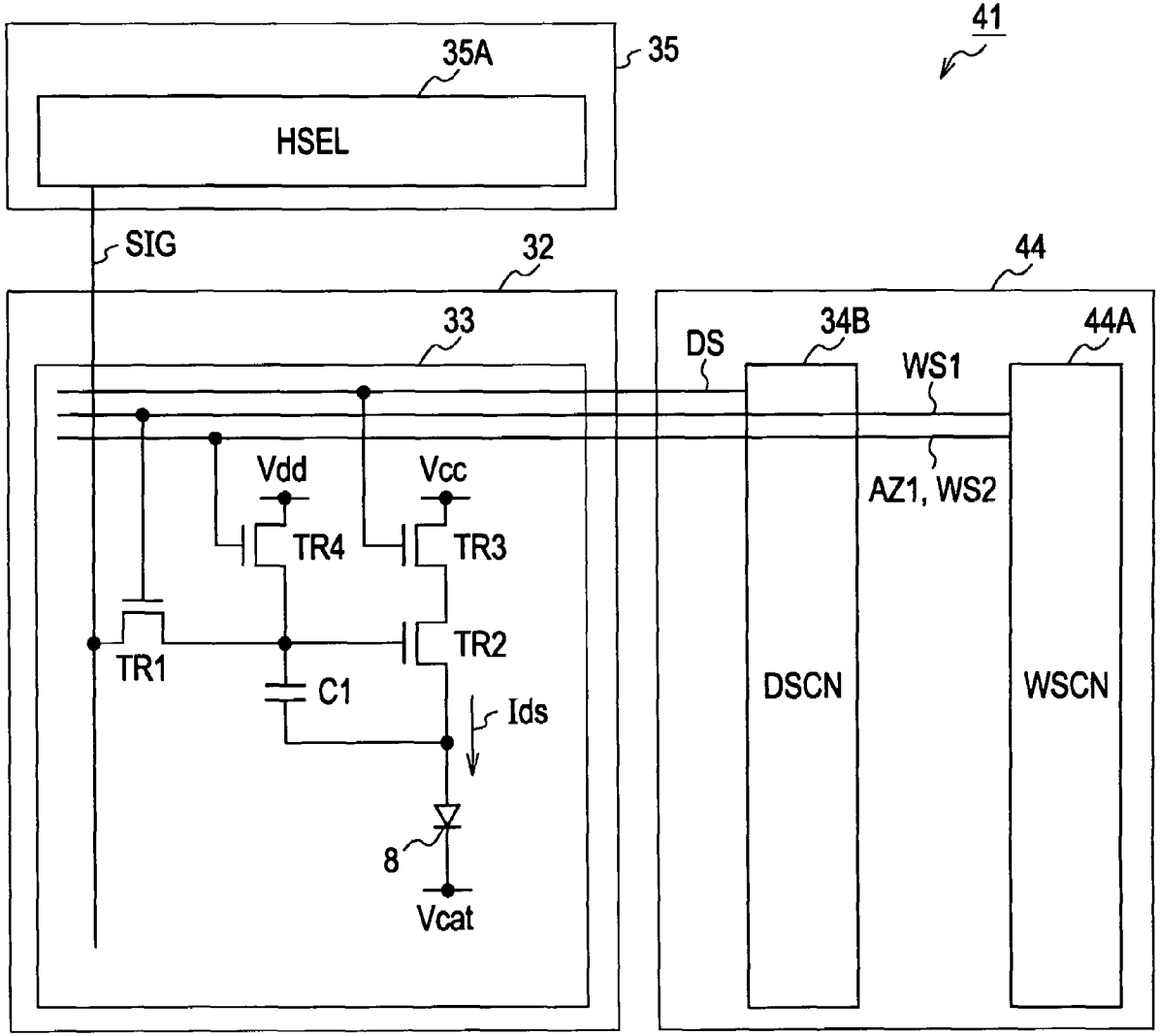
FIG. 12 is a block diagram showing a display device according to a second embodiment of the present invention.

FIG. 12 is a block diagram showing a display device according to a second embodiment of the present invention. FIG. 12 is used for comparison with FIG. 1. A display device 41 according to the second embodiment is configured similarly to the display device 31 according to the first embodiment, with the exception of a configuration relating to a control signal AZ1.

Figure 13:
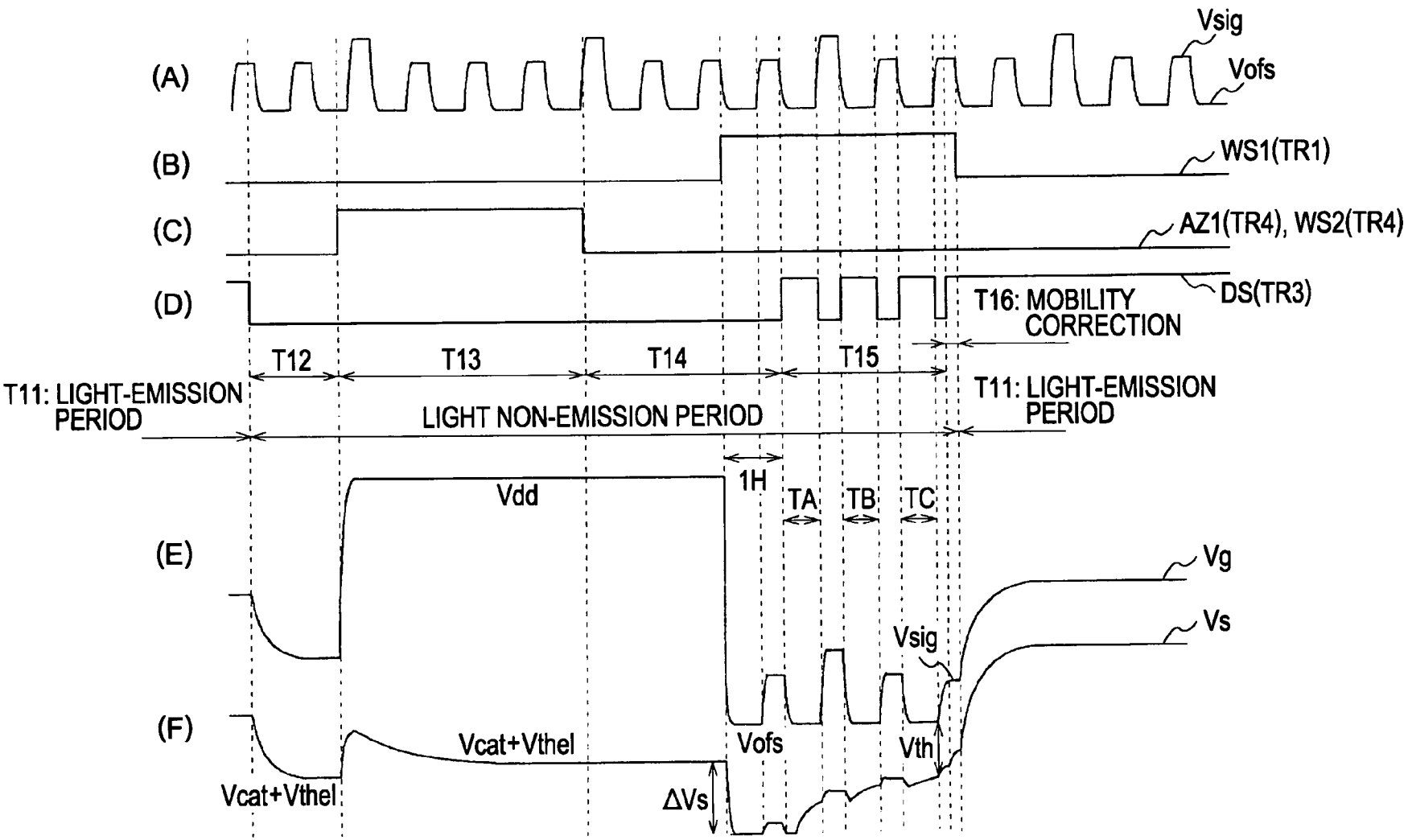
FIG. 13 is a timing chart of the display device shown in FIG. 12.

In the display device 41, a vertical driving circuit 44 does not include a control-signal generation circuit, and a write scan circuit 44A generates a control signal AZ1. As shown in FIG. 13, due to the wiring for scanning lines of the pixel area 32, the write scan circuit 44A outputs a write signal WS2, which is output for a pixel 33 preceding the current pixel 33 by a plurality of lines, as a control signal AZ1. Thus, the write scan circuit 44A outputs, as a write signal to the current pixel 33, and as a control signal AZ1 to a pixel 33 succeeding the current pixel 33 by a plurality of lines, a write signal WS for one line.

Thus, in the display device 41, the configuration of the vertical driving circuit 44 can be simplified. Thus, a so-called reduction in the size of a frame can be achieved.

With the configuration shown in FIG. 12, since a write signal WS2 output to a pixel 33 preceding the current pixel 33 by a plurality of lines is used as a control signal AZ1, the configuration of the vertical driving circuit can be simplified.

Third Embodiment

Although cases where a light-emitting element as an organic EL element is driven by a current have been described in the above-described embodiments, the present invention is not limited to this. The present invention is widely applicable to a display device using any type of current-driven light emitting element.

It should be understood by those skilled in the art that various modifications, combinations, subcombinations and alterations may occur depending on design requirements and other factors insofar as they are within the scope of the appended claims or the equivalents thereof.

What is claimed is:

1. A display device comprising:

a pixel area where a plurality of pixels are arranged in a matrix; and a driving circuit for driving the pixel area, wherein each of the pixels includes a signal-level holding capacitor having two ends, a first transistor that is turned on and off in accordance with a write signal, the first transistor connecting one end of the signal-level holding capacitor to a signal line, a second transistor having a gate connected to the one end of the signal-level holding capacitor and a source connected to the other end of the signal-level holding capacitor, a current-driven self-luminous light-emitting element having a cathode held at a cathode potential and an anode connected to the source of the second transistor, a third transistor that is turned on and off in accordance with a driving-pulse signal, the third transistor connecting a drain of the second transistor to a power-supply voltage, and a fourth transistor that is turned on and off in accordance with a control signal, the fourth transistor setting the one end of the signal-level holding capacitor to have a first fixed potential, wherein the driving circuit outputs the write signal, the driving-pulse signal, and the control signal, alternately sets the signal line to have a second fixed potential and to have a signal level corresponding to a grayscale level of each pixel connected to the signal line, drives the pixel area by sequentially cyclically repeating settings performed in first to fifth periods, in the first period, sets the first and fourth transistors to be off in accordance with the write signal and the control signal, sets the third transistor to be on in accordance with the driving-pulse signal, and drives the self-luminous light-emitting element using the second transistor in accordance with a current value corresponding to a gate-source voltage based on a potential difference across the signal-level holding capacitor to cause the self-luminous light-emitting element to emit light, in the second period, sets the third transistor to be off in accordance with the driving-pulse signal to cause the self-luminous light-emitting element to stop emitting light, in the third period, after setting the fourth transistor to be on in accordance with the control signal so that the one end of the signal-level holding capacitor exhibits the first fixed potential, sets the fourth transistor to be off in accordance with the control signal, and sets the first transistor to be on in accordance with the write signal during a period in which the signal line is set to have the second fixed potential, so that the one end and the other end of the signal-level holding capacitor exhibit the second fixed potential and a predetermined potential, in the fourth period, during a period in which the signal line is repeatedly set to have the second fixed potential a plurality of times, in a state where the first transistor is set to be on in accordance with the write signal and the fourth transistor is set to be off in accordance with the control signal, in a period in which the signal line is set to have the second fixed potential, sets the third transistor to be on in accordance with the driving-pulse signal so that the potential difference across the signal-level holding capacitor is set to be substantially equal to a threshold voltage of the second transistor, and in the fifth period, sets the on-state first transistor to be off in accordance with the write signal so that the one end of the signal-level holding capacitor is set to have the signal level of the signal line.

2. The display device according to claim 1, wherein the first fixed potential is the same as the power-supply voltage.

3. The display device according to claim 1, wherein in the fifth period, after the driving circuit sets the third transistor to be on in accordance with the driving-pulse signal and a predetermined period of time has elapsed, the driving circuit sets the first transistor to be off in accordance with the write signal.

4. The display device according to claim 1, wherein the driving circuit outputs, as the control signal, the writing signal that is to be output to a pixel preceding the current pixel by a plurality of lines.

5. The display device according to claim 1, wherein all the transistors in the pixels and the driving circuit are of an N-channel type, and wherein the pixels and the driving circuit are formed on an insulating substrate by an amorphous silicon process.

* * * * *